US006145830A

United States Patent [19]

Uchida et al.

[11] Patent Number: 6,145,830

[45] Date of Patent: Nov. 14, 2000

[54] SHEET MATERIAL SUPPLYING APPARATUS

[75] Inventors: Kohji Uchida; Hiroyuki Kohda; Yasuhiro Endo; Atsuhiro Doi, all of Kanagawa, Japan

[73] Assignee: Fuji Photo Film Co., Ltd., Kanagawa, Japan

[21] Appl. No.: 09/007,764

[22] Filed: Jan. 15, 1998

[51] Int. Cl.[7] ..... B65H 5/08

[52] U.S. Cl. ..... 271/11; 271/20; 271/24; 271/104; 271/30.1; 271/107; 271/108; 271/167

[58] Field of Search ..... 271/11, 20, 14, 271/90, 104, 105, 106, 107, 108, 167, 170, 24, 30.1; 414/797; 294/64.1

[56] References Cited

U.S. PATENT DOCUMENTS

| | | | |
|---|---|---|---|
| 949,850 | 2/1910 | Smith | 294/64.1 |
| 4,106,765 | 8/1978 | Britt et al. | 271/170 |
| 4,548,396 | 10/1985 | Nelen | 271/90 |
| 4,593,947 | 6/1986 | Yocum | 294/64.1 |
| 4,858,976 | 8/1989 | Stoll | 294/64.1 |
| 4,921,237 | 5/1990 | Nubson et al. | 271/11 |
| 5,052,672 | 10/1991 | Horii | 271/11 |
| 5,171,007 | 12/1992 | Kasprzak et al. | 271/167 |
| 5,213,385 | 5/1993 | Nagai et al. | 294/64.1 |
| 5,531,531 | 7/1996 | Hirano | 271/170 |
| 5,826,870 | 10/1998 | Vulgamore et al. | 271/167 |
| 5,876,031 | 3/1999 | Ohkoda et al. | 271/14 |

FOREIGN PATENT DOCUMENTS

| | | | |
|---|---|---|---|
| 1 392 278 | 2/1965 | France | 294/64.1 |
| 404 064 537 | 2/1992 | Japan | 271/107 |
| 5-181246 | 7/1993 | Japan | G03C 8/40 |
| 6-161070 | 6/1994 | Japan | G03C 8/40 |
| 6-242546 | 9/1994 | Japan | G03C 1/498 |
| 6-289555 | 10/1994 | Japan | G03C 8/40 |

*Primary Examiner*—H. Grant Skaggs

*Attorney, Agent, or Firm*—Sughrue, Mion, Macpeak & Seas, PLLC

[57] ABSTRACT

A sheet material supplying apparatus having a low-cost sucker adsorbing unit of a simple structure is provided for the carrying of sheet materials that are used under a high-humidity environment or that include humidity, to ensure a proper separation of each sheet material. Sheet materials accommodated in a tray are being sandwiched between a push-up panel and an engagement claw. At the time of taking out the sheet materials from the tray, the push-up panel is pressed down by a cam to cancel the state of sandwiching between the engagement claw and the push-up panel. Accordingly, only the top layer sheet material is taken out from the tray, with the rest of the lower layer sheet materials being dropped by their self-weight. Further, the sheet materials are carried by the sucker adsorbing unit. When a sucker adsorbing a sheet material by a negative pressure has moved to a carrying roller, a sucker supporting section is elastically deformed by a sucker pressing unit, so that the negative pressure within the sucker can be cancelled. Accordingly, a complex control system is not required for cancelling the negative pressure.

16 Claims, 22 Drawing Sheets

SHEET MATERIAL SUPPLYING APPARATUS

BACKGROUND OF THE INVENTION

1. Field of the Invention

The present invention relates to a sheet material supplying apparatus for feeding a sheet material such as a copying paper sheet, and relates more particularly to a sheet material supplying apparatus which includes an adsorbing unit for adsorbing a material to be adsorbed by a sucker and which is suitable for supplying an image forming material of an image recording apparatus onto which an image is to be formed by being transferred after development.

2. Description of Related Art

As an image recording apparatus, a structure is known in which a plurality of sheet materials cut into a predetermined size are accommodated in a laminated state in a sheet feeding tray and each one sheet is taken out of this tray for being supplied to an image forming section at the time when an image is formed.

The image recording apparatus of this type has a sheet feeding apparatus (a sheet material supplying apparatus) for supplying a plurality of sheet materials accommodated in the sheet feeding tray in a laminated state to a nip roller by taking out only the top layer sheet of the sheet materials from the tray by a friction between this sheet and a detaching roller rotating above the sheet materials.

However, in an image recording apparatus which is structured to transfer an image onto an image receiving material that is a sheet material after the image formed on a photo-sensitive material has been thermally developed, the image forming surface of the image receiving material is always wet and is easily adhered to other sheet when the sheets are laminated together because a coloring matter fixing material having a mordant is coated on the image forming surface of the image receiving material. Accordingly, there occurs a problem that not only the top layer sheet material but also a plurality of sheet materials reaching the lower layer are sent to the nip roller which results in a sheet feeding failure. Further, if the image recording apparatus is to be used in a high humidity atmosphere, the sheet materials come to be adhered to each other more easily.

Although it is possible to solve the sheet supplying failure by increasing the friction between the feeding roller and the image receiving material, the image forming surface is damaged by the friction between the feeding roller and the image receiving material when the image receiving material is to be accommodated in the sheet feeding tray by facing the image forming surface upward (that is, by facing the image forming surface to the feeding roller side).

Further, in the case of a sheet feeding apparatus for feeding a plurality of laminated sheet materials one by one from the top layer sheet, such as an image receiving material to be used for a thermal development and transfer or a sensitized sheet to be used for an X-ray photograph for medical purpose, for example, the use of a detaching roller like a sheet feeding apparatus that is used for a general copying machine or printer will cause a damage to the surface of the sheet materials by the friction between the sheet materials and the detaching roller. Therefore, a sheet feeding apparatus for feeding sheet materials by adsorbing the surface of the top layer sheet material is being used for the image receiving materials or the sensitized sheets.

In other words, the sheet feeding apparatus for the sheet materials of this type has a sucker disposed above the sheet materials. The sucker is brought into contact with the surface of the sheet material, then generates a negative pressure inside the sucker by a pump for evacuating air from inside the sucker by an elastic deformation of the sucker or through a hose or the like so that the sheet material is carried by being lifted in an adsorbed state. When the carrying of the sheet material is finished, the negative pressure inside the sucker is cancelled by sending air to the inside of the sucker by the pump through the hose or by releasing a valve connected to the sucker through the hose so that the adsorption of the sheet material is cancelled.

According to the sheet feeding apparatus of the above-described structure, however, the pump, the valve and the like are necessary in order to cancel the negative pressure within the sucker, and further, the hose is also necessary for connecting the pump and the valve with the sucker. Therefore, this arrangement becomes expensive and this also makes the overall apparatus complex. Furthermore, since a driving unit such as a motor for driving the sucker and the pump and the valve must be connected together in order to operate or release the pump and the valve at a predetermined carrying position, a control unit for this purpose becomes necessary. As a result, the overall apparatus becomes more complex and more expensive.

SUMMARY OF THE INVENTION

By taking the above-described facts into consideration, it is an object of the present invention to provide a sheet material supplying apparatus which includes an adsorbing unit with a simple structure for carrying out an adsorption control and which can supply sheet materials by properly dividing the sheets even if the sheet material supplying apparatus is used in a high-humidity atmosphere or when the sheet materials used are the sheets including humidity such as image receiving sheet materials.

According to one aspect of the sheet material supplying apparatus of the present invention, when the top layer sheet material is taken out from the other plurality of sheet materials in a laminated state, the top layer sheet material can be separated securely without damaging the surface of this sheet due to a friction.

In this sheet material supplying apparatus, it is characterized that a pushing up of an engagement claw by a pushing up unit is cancelled in the state that a corner portion of the sheet material on the top layer is engaged with the engagement claw and that an adsorbing unit adsorbs the sheet material of the top layer.

According to the sheet material supplying apparatus of the above-described structure, the push-up force by the push-up unit is cancelled in the state that the corner portion of the sheet material on the top layer is engaged with the engagement claw and the adsorbing unit adsorbs the sheet material of the top layer, so that the sandwiching state of the sheet material between the push-up unit and the engagement claw is cancelled temporarily. In this case, since the sheet material on the top layer is being adsorbed by the adsorbing unit in this state, the corner portion of the top layer sheet material is kept in contact with the engagement claw even after the cancellation of the sandwiching state between the push-up unit and the engagement claw. However, the sheet materials in the second layer and after positioned below the top layer sheet material are separated from the top layer sheet material because of the self-weight of these sheet materials. Thus, the sheet materials in the second layer and after are separated from the top layer sheet material.

The above-described sheet material supplying apparatus is characterized in that the push-up unit has a push-up panel for pushing the sheet material upward and that the push-up panel is pressed down by the cancelling unit in a direction to leave from the engagement claw.

According to the sheet material supplying apparatus of the above-described structure, the cancelling unit presses down the push-up unit in a direction to leave from the engagement claw. In this case, since the push-up unit always pushes up the sheet material to an opening side, the push-up unit can move in a direction to be in contact with and leave from the bottom portion of the tray. Accordingly, by keeping the engagement claw to be always static together with the tray and by simply pressing down the push-up unit toward the bottom side of the tray by the cancelling unit, the push-up unit can be separated from the engagement claw. Therefore, this structure is simple and inexpensive as compared with the structure for moving the engagement claw in a direction to leave from the push-up unit by forcibly making static the push-up unit for pushing up the sheet material, for example.

An adsorbing unit using a sucker which is another important aspect of the present invention is the adsorbing unit for adsorbing a material to be adsorbed by a negative pressure within an adsorbing umbrella section, stretched from a supporting section and extending to the front, by bringing the adsorbing umbrella section to be in contact with the material to be adsorbed. This sucker adsorbing unit is characterized in that it has a cancelling unit which cancels the adsorption by elastically deforming the supporting section so that the inside of the adsorbing umbrella section is communicated with an external air through the elastically deformed section of the supporting section.

According to the sucker adsorbing unit of the above-described structure, when a negative pressure is generated within the adsorbing umbrella section in a state that the adsorbing umbrella section is brought into contact with the material to be adsorbed by an exhaust pump or the like communicated with the inside of the adsorbing umbrella section through a pipe or by an elastic deformation of the adsorbing umbrella section stretched from the supporting section, the material to be adsorbed is adsorbed by the adsorbing umbrella section.

When the supporting section is elastically deformed by the cancelling unit in this state, the inside of the adsorbing umbrella section is communicated with the external air through the elastically deformed section. Accordingly, the negative pressure of the adsorbing umbrella section is cancelled and the adsorption of the material adsorbed is cancelled.

In the above-described sucker adsorbing unit, it is characterized that a through-hole connecting to the inside of the adsorbing umbrella section is provided in the supporting section, and that the through-hole is communicated with the external air by the elastic deformation of the supporting unit according to the cancelling unit.

According to the sucker adsorbing unit of the above-described structure, when the supporting section is elastically deformed in the state that the adsorbing umbrella section adsorbs the material to be adsorbed and then when the through-hole of the supporting section is communicated with the external air, the inside of the adsorbing umbrella section is communicated with the external air through this through-hole. As a result, the negative pressure of the adsorbing umbrella section is cancelled and the adsorption of the material adsorbed is cancelled.

In the above-described sucker adsorbing unit, it is characterized that a sucker supporting arm for supporting the supporting section is inserted into the through-hole.

According to the sucker adsorbing unit of the above-described structure, the adsorption supporting arm is also inserted into a supporting hole of the supporting section so that the sucker is supported by the adsorption supporting arm. In this case, when the supporting section is elastically deformed in the state that the adsorbing umbrella section adsorbs the material to be adsorbed so that a gap is formed between the supporting hole and the sucker supporting arm and thus the through-hole is communicated with the external air, the inside of the adsorbing umbrella section is communicated with the external air through this through-hole. As a result, the negative pressure of the adsorbing umbrella section is cancelled and the adsorption of the material adsorbed is cancelled.

The above-described sucker adsorbing unit is characterized in that it includes the cancelling unit for communicating the through-hole with the external air by elastically deforming the supporting unit in a direction of an expanded diameter.

According to the sucker adsorbing unit of the above-described structure, when the supporting section is elastically deformed by the cancelling unit, the through-hole is communicated with the external air, and the inside of the adsorbing umbrella section is communicated with the external air through this through-hole. Accordingly, the negative pressure of the adsorbing umbrella section is cancelled and the adsorption of the material adsorbed is cancelled.

DETAILED DESCRIPTION OF THE PREFERRED EMBODIMENTS

Figure 20:
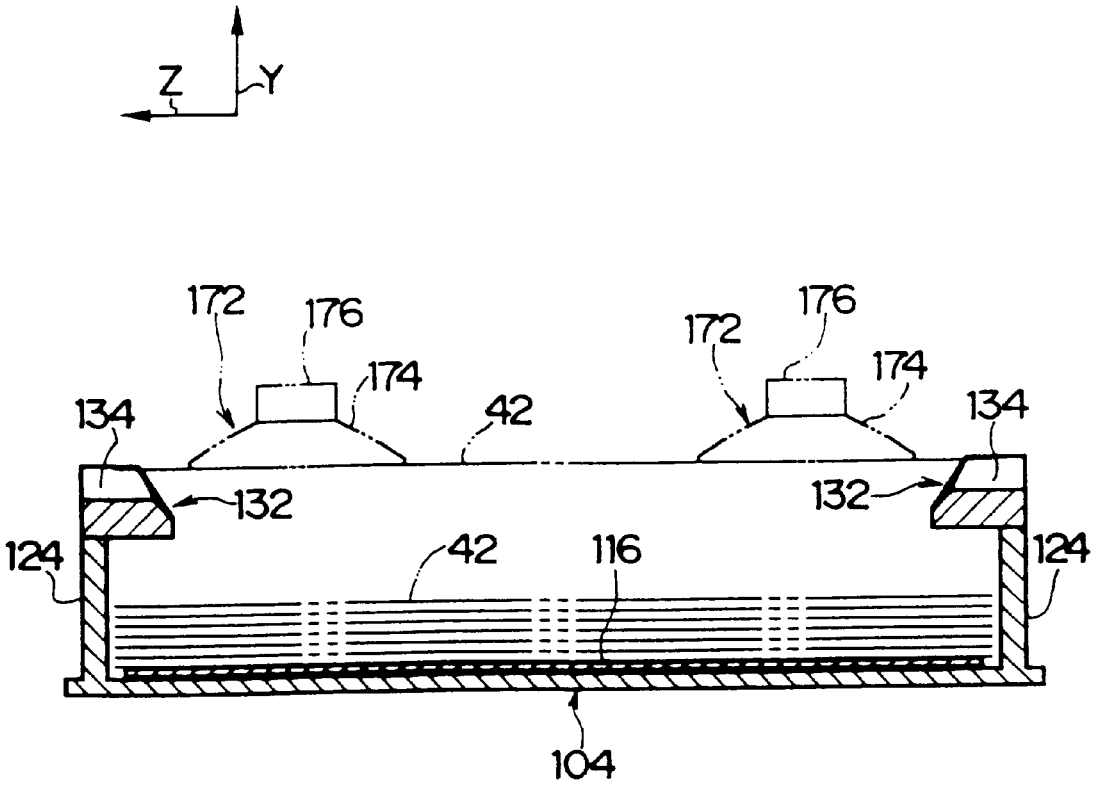
FIG. 20 is a front cross-sectional view of the tray for showing the state of the material to be adsorbed, the push-up unit and the sucker in the state of FIG. 14.
Figure 21:
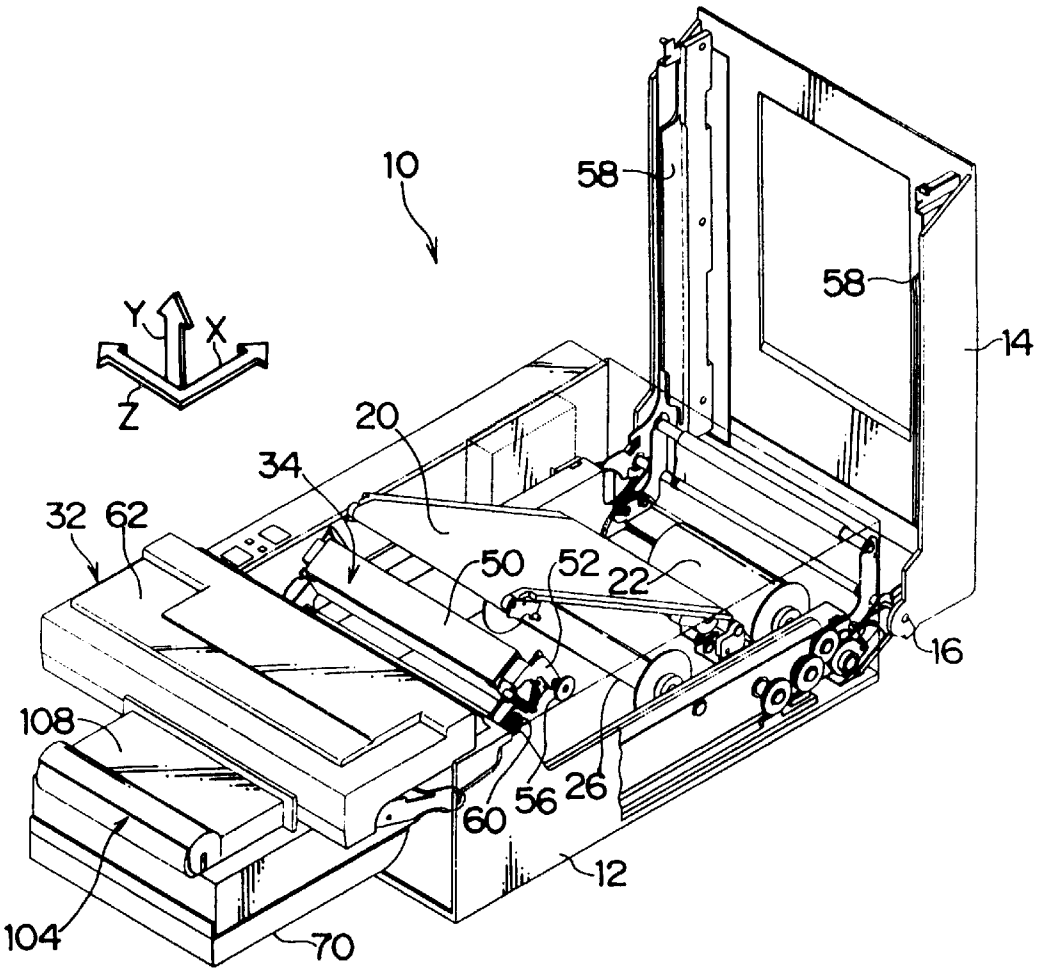
FIG. 21 is a perspective view of an image recording apparatus to which the sucker adsorbing unit relating to one mode of implementation of the present invention is applied.
Figure 22:
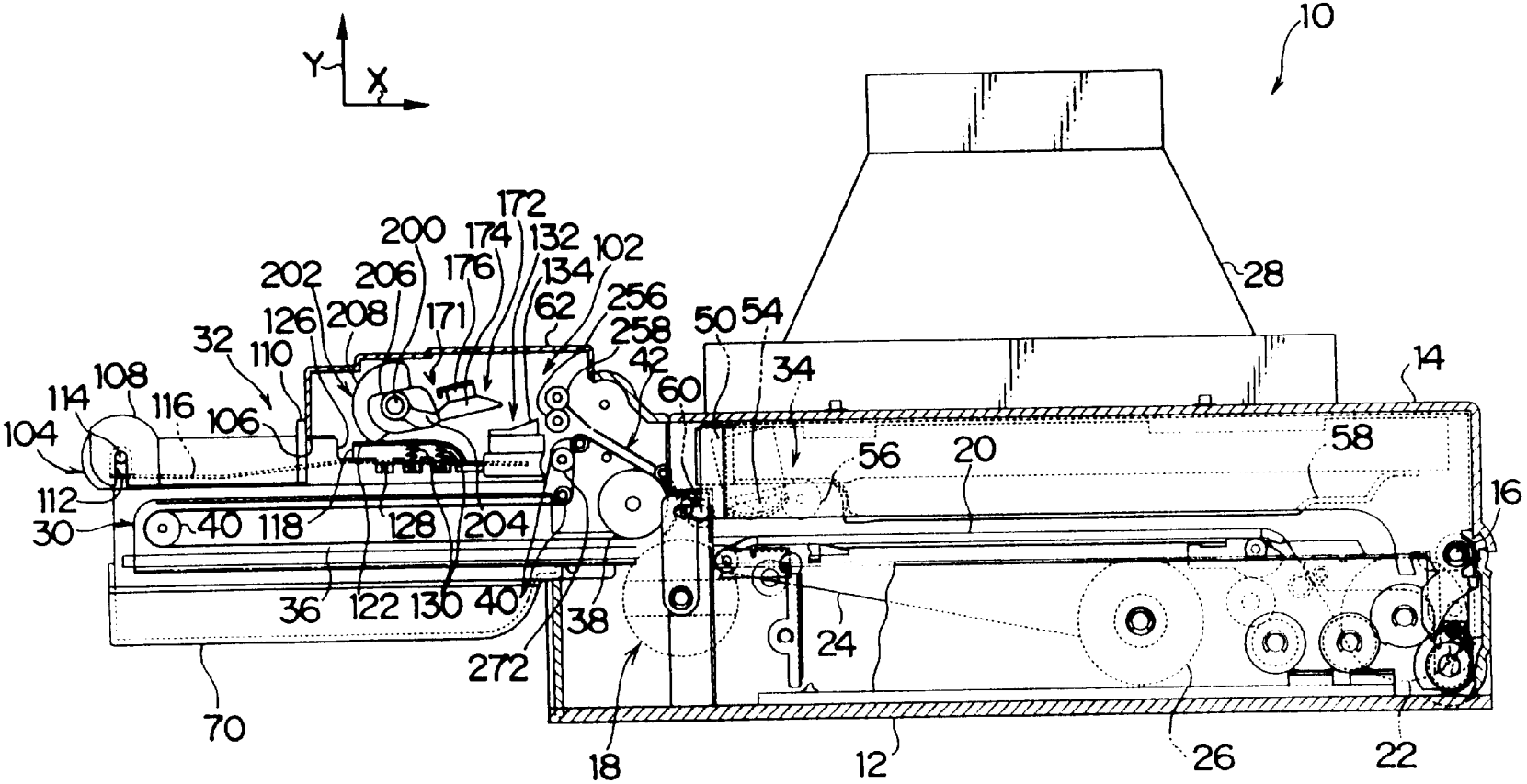
FIG. 22 is a side cross-sectional view of the image recording apparatus to which the sucker adsorbing unit relating to one mode of implementation of the present invention is applied.

FIG. 21 shows in a perspective view an overall structure of an image recording apparatus 10 to which a sucker adsorbing unit relating to an embodiment of the present invention is applied, and FIG. 22 shows in a side cross-sectional view of the image recording apparatus 10. In the following explanation, a direction of an arrow X in FIGS. 1 to 22 which is the direction of supplying an image receiving material 42 to be described later will be called a "forward" direction and a direction opposite to the direction of supplying the image receiving material 42 will be called a "backward" direction. When there is no particular explanation, the side to which a sheet material is supplied in each part (the side directed by the arrow X) will be called the "front end side" and the side opposite to this supplying direction will be called the "back end side".

The overall shape of the image recording apparatus 10 is formed in a hollow box shape by a base 12 and an upper cover 14. The upper cover 14 has its front end side (the right end side on the paper in FIGS. 21 and 22) connectedly supported by the base 12 through a hinge axis 16 so that the upper cover 14 can be opened or closed by rotating the upper cover 14 around the hinge axis 16. A locking section 18 is provided at the back end side of the base 12 and the upper cover 14, and the upper cover 14 is usually held in a closed state.

On the other hand, a stage 20 is provided at the center portion within the base 12. The stage 20 is a plane-shaped heating disc disposed horizontally.

At the front end side of the stage 20 (at the side of the hinge axis 16), a supplying magazine 22 is provided below the stage 20, and this supplying magazine 22 accommodates a photo-sensitive material 24 as an image recording material wound up in a roll shape. The photo-sensitive material 24 is structured to include a photo-sensitive halogenated silver emulsion, a binder, a coloring matter dative substance, and a reducing agent on the surface of a supporting unit formed in a band shape. The photo-sensitive material 24 has its photo-sensitive surface faced up ward in the state the photo-sensitive material 24 is drawn out from the supplying magazine 22 onto the stage 20 and held horizontally on the stage 20.

Below the stage 20, a winding magazine 26 is disposed adjacent to the supplying magazine 22. A drawing direction side of the photo-sensitive material 24 wound on the surface of the stage 20 by being drawn out from the supplying magazine 22 is wound up in the winding magazine 26. This photo-sensitive material 24 is drawn out onto the stage 20 by a predetermined length each time and then wound up in the winding magazine 26.

As shown in FIG. 22, an exposing unit 28 is fitted to oppose the stage 20 above the base 12. The exposing unit 28 has a light source (not shown) which exposes a light reflected from a draft after an irradiation on the draft or a transmission light onto the photo-sensitive material 24 positioned on the stage 20. It is also good to structure such that an image of the draft is sequentially exposed by scanning on the photo-sensitive material 24 by moving the light source along the draft. Alternately, it is also good to structure such that a reflection light or a transmission light is exposed by scanning on the draft by a breakdown image signal.

Further, the image recording apparatus 10 has a pasting unit 30, a sheet feeding section 32 and a water coating section 34.

The pasting unit 30 has an endless belt 36 applied to a pasting roller 38 and a plurality of winding rollers 40. The pasting unit 30 can sequentially move on the stage 20 from a waiting position (the back end position of the base 12 as shown in FIG. 22) toward the front end portion of the stage 20 (the right end portion in FIG. 22). Along with the proceeding of the pasting unit 30, the endless belt 36 runs on the stage 20 corresponding to the proceeding of the pasting unit 30 (runs in the clockwise direction in FIG. 22).

The sheet feeding section 32 is provided inside a cover 62 adjacently disposed at the rear side of the upper cover 14 immediately above the pasting unit 30 at the waiting position. A tray 104 is mounted in the sheet feeding section 32. Inside the tray 104, there is accommodated the image receiving material 42 as the material to be adsorbed which is cut into a plurality of sheets with a predetermined length and in lamination, at a level almost in parallel with the stage 20. One side of the image receiving material 42 is coated with a coloring matter fixing material having a mordant to prepare an image forming surface, and this image receiving material 42 is accommodated in the tray 104 in the state that the image forming surface faces upward. In the sheet feeding section 32, a sucker 172 is provided above the front end side of the tray 104, and a guiding section 44 is provided corresponding to the pasting roller 38 of the pasting unit 30 located at the waiting position. The structure of the sheet feeding section 32 including the tray 104 and the sucker 172 will be explained in further detail at the later stage.

Along with the running of the pasting unit 30 (the endless belt 36), the image receiving material 42 within the tray 104 is taken out by being adsorbed by the sucker 172 and is then sent through the guiding section 44 to the pasting roller 38 (the outer periphery of the endless belt 36) of the pasting unit 30 located at the waiting position. Further, the image receiving material 42 sent to the pasting roller 38 (the outer periphery of the endless belt 36) of the pasting unit 30 located at the waiting position is inverted by moving together with the endless belt 36. The front end of the image receiving material 42 is brought into contact with the photo-sensitive material 24, and along with the move of the pasting unit 30, the image receiving material 42 is sandwiched between the endless belt 36 and the photo-sensitive material 24 so that the image receiving material 42 is sequentially superposed with the photo-sensitive material 24.

On the other hand, the water coating section 34 has a tank 50. This tank 50 is a long rectangular box shape, disposed along the width direction of the stage 20 (from this side to the depth side direction in FIG. 22), and is, at the same time, supported movably to the pasting unit 30 in the upper and lower directions by a supporting arm 52. Accordingly, the tank 50 can move sequentially along the stage 20 together with the pasting unit 30. A transfer agent such as water (a solvent for forming an image) is sealed within the tank 50. A sponge 54 is provided at the bottom of the tank 50. The sponge 54 can absorb and hold the water within the tank 50.

A guide wheel 56 is provided in the water coating section 34. The guide wheel 56 corresponds to a staged guide rail 58 provided in the base 12 (the upper cover 14) and moves along the guide rail 58. When the guide wheel 56 moves along the guide rail 58, the tank 50 is guided in upper and lower directions. Along with the lifting up or falling down of the tank 50, the sponge 54 also moves up or down so that water is coated on only the necessary portion of the photo-sensitive material 24.

Sizes at various positions are set so that the sponge 54 is separated from the photo-sensitive material 24 on the stage 20 when the tank 50 is at a lifted position and that the sponge 54 is brought into contact with the photo-sensitive material 24 on the stage 20 when the tank 50 is at a fallen position. In the state that the sponge 54 is brought into contact with the photo-sensitive material 24 by being pressed against this photo-sensitive material 24, the sponge 54 is compressed so that the water flow out of the sponge 54 to the photo-sensitive material 24. When the water coating section 34 (the sponge 54) further proceeds in this state, the water is coated sequentially onto the photo-sensitive material 24.

Further, a squeezing roller 60 is disposed at the back side of the tank 50 (the opposite side of the guide wheel 56). The squeezing roller 60 moves together with the tank 50 (the sponge 54) and can remove surplus water coated on the photo-sensitive material 24.

After an image of a draft has been exposed on the photo-sensitive material 24, the sheet feeding section 32 supplies the image receiving material 42, the water coating section 34 coats water on the photo-sensitive material 24, and the pasting unit 30 pastes the image receiving material 42 with the photo-sensitive material 24. Then, a thermal development and transfer is carried out on the stage 20 in the state that the image receiving material 42 and the photo-sensitive material 24 are superposed with each other. In other words, a movable coloring matter of the photo-sensitive material 24 is discharged, and the coloring matter is transferred onto the coloring matter fixing layer of the image receiving material 42 at the same time, so that an image is obtained on the image receiving material 42.

Thereafter, the exposed portion of the photo-sensitive material 24 is wound up in the winding magazine 26, with the unexposed portions disposed on the stage 20. By this feeding, the image receiving material 42 is separated from the photo-sensitive material 24 and is sent out to an exhaust tray 70.

Next, the structure of the sheet feeding section 32 will be explained with reference to FIGS. 1 to 20.

Figure 1:
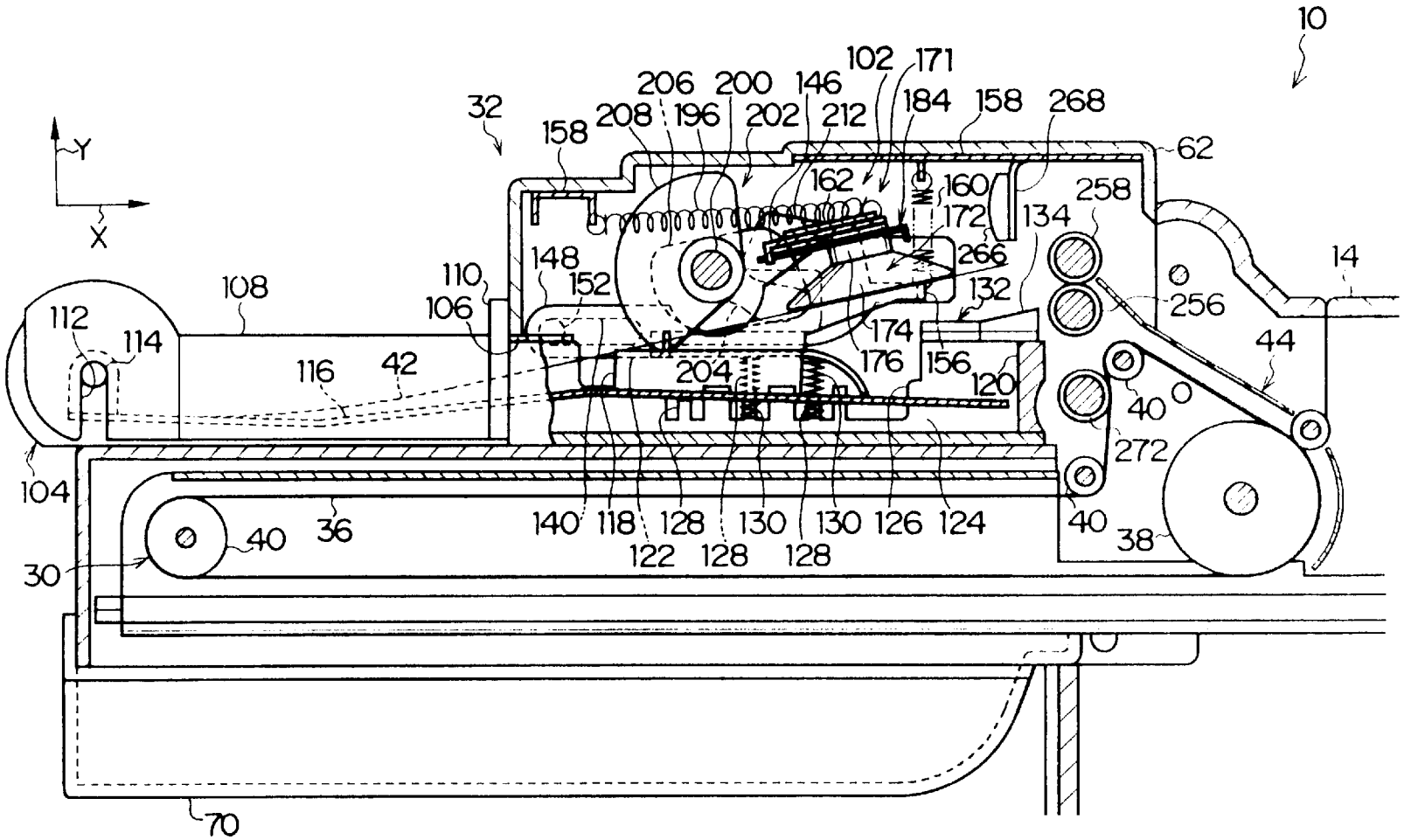
FIG. 1 is an enlarged side cross-sectional view of a sheet feeding section of an image recording apparatus to which the sucker adsorbing unit relating to one mode of implementation of the present invention is applied.
Figure 2:
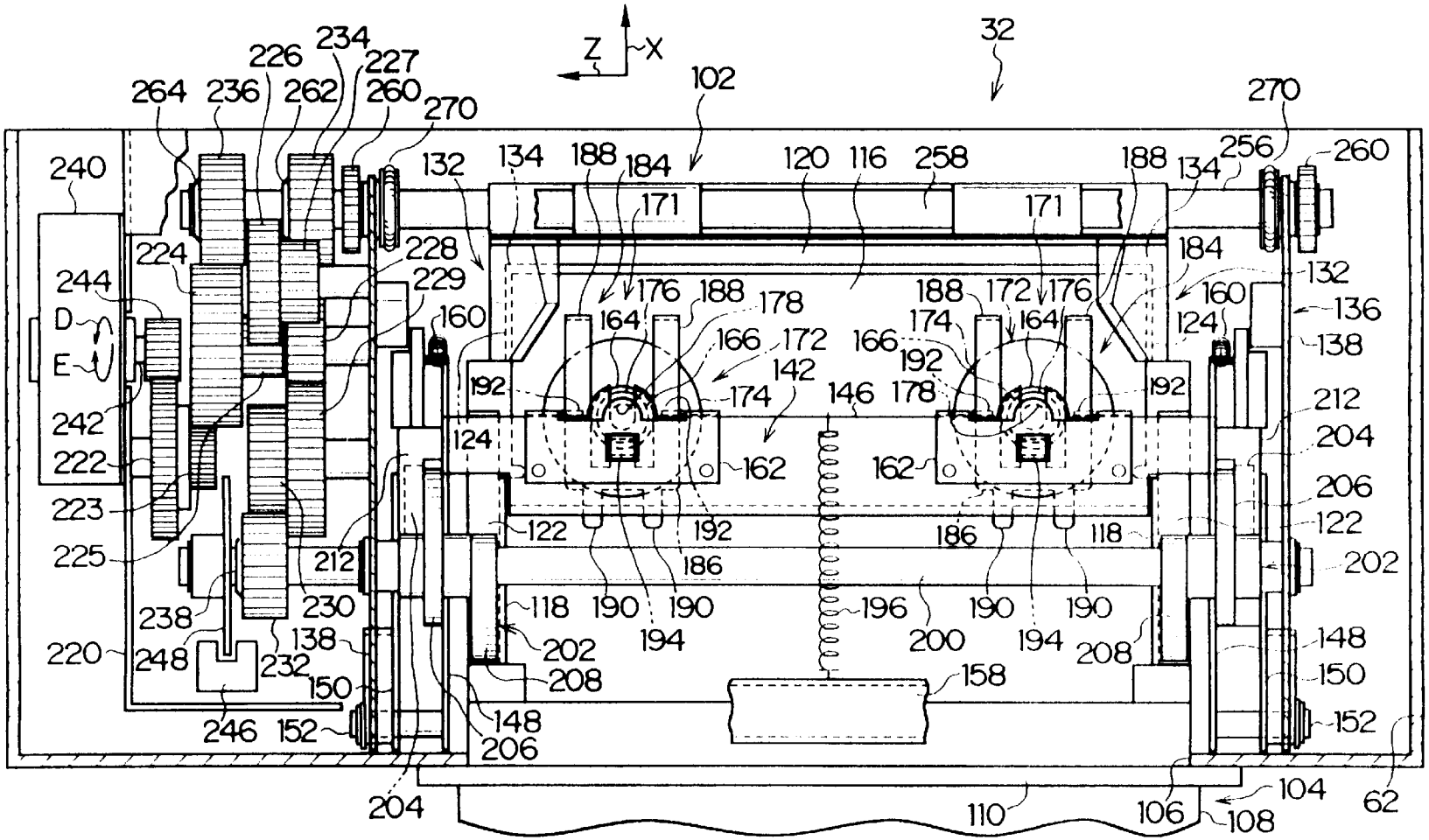
FIG. 2 is an enlarged top plan view of the sheet feeding section of the image recording apparatus to which the sucker adsorbing unit relating to one mode of implementation of the present invention is applied.

As shown in FIGS. 1 and 2, the sheet feeding section 32 has a sheet feeding section main body 102 and a tray 104 provided inside the cover 62.

Figure 3:
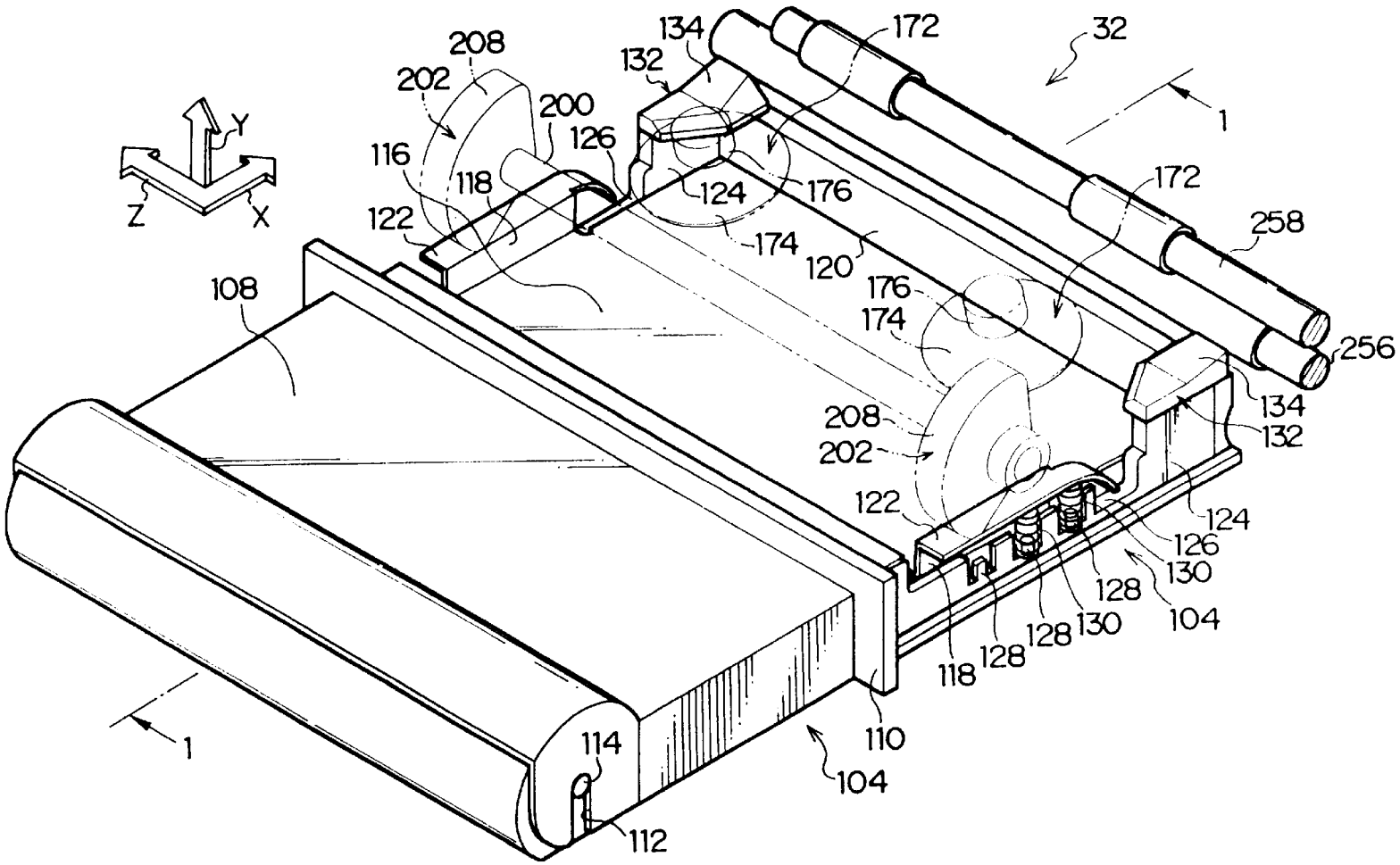
FIG. 3 is an enlarged perspective view of the sheet feeding section of the image recording apparatus to which the sucker adsorbing unit relating to one mode of implementation of the present invention is applied.

The tray 104 has a box shape with the upper side open and can accommodate the above-described plurality of sheets of the image receiving material 42 in a laminated state, as shown in FIG. 3. Further, as shown in FIGS. 1 and 2, the tray 104 is structured such that its front end side can be inserted into an opening section 106 formed on the cover 62 in the arrow X direction as shown in FIGS. 1 and 2 and extracted from this opening section 106 in the opposite direction. Further, as shown in FIGS. 1 to 3, the tray 104 is provided with a cover 108, by which the half portion of the tray 104 from its back end side is covered from upward. A flange section 110 is formed in the front end portion of this cover 108. When the tray 104 is inserted into the inside of the cover 62 up to a predetermined position through the opening section 106, the flange section 110 is brought into contact with a side wall of the cover 62 to thereby control the insertion quantity of the tray 104. Recesses 112 are formed on both end portions in the width direction of the back end side of the cover 108 (an arrow Z direction and its opposite direction in FIG. 3). Pins 114 formed in projection from both end portions of the width direction of the back end side of the tray 104 are inserted into these recesses 112. The cover 108 can be opened or closed by lifting the cover 108 in the state that the tray 104 is completely inserted into the opening section 106 or by rotating the cover 108 around these pins 114 in the state that the tray 104 is slightly extracted from the opening section 106.

On the other hand, inside the tray 104, there is provided a push-up panel 116 as a push-up unit having its back end portion fixed to the tray 104. The image receiving material 42 is mounted on the push-up panel 116. At the intermediate section in the forward and backward directions of the push-up panel 116, there are formed vertical walls 118 along both end portions in the width direction of the push-up-panel 116, to enable positioning of the accommodated image receiving material 42 in the width direction. In this case, a side wall 120 is provided at the front end portion of the tray 104 to enable the positioning of the image receiving material 42 in the feeding direction by bringing the front end portion of the image receiving material 42 into contact with the side wall 120.

Further, in each vertical wall 118, there is formed a bent section 122 bent at a right angle toward the outside in the width direction of the push-up panel 116 from the upper end portion, to enter each recess 126 formed at the upper end portion of each side wall 124 at both end sides in the width direction of the tray 104, with the lower surface of each bent section 122 being opposed to the upper end portion of each recess 126.

In each recess 126 of each side wall 124, there are formed a plurality of block-shaped pins 128, of which two pins are fitted with springs 130. These springs 130 have their lower end portions brought into contact with the recess 126 of the side wall 124 and have their upper end portions brought into contact with the lower surface of the bent section 122, to thereby push the push-up panel 116 upward through the vertical wall 118.

Figure 6:
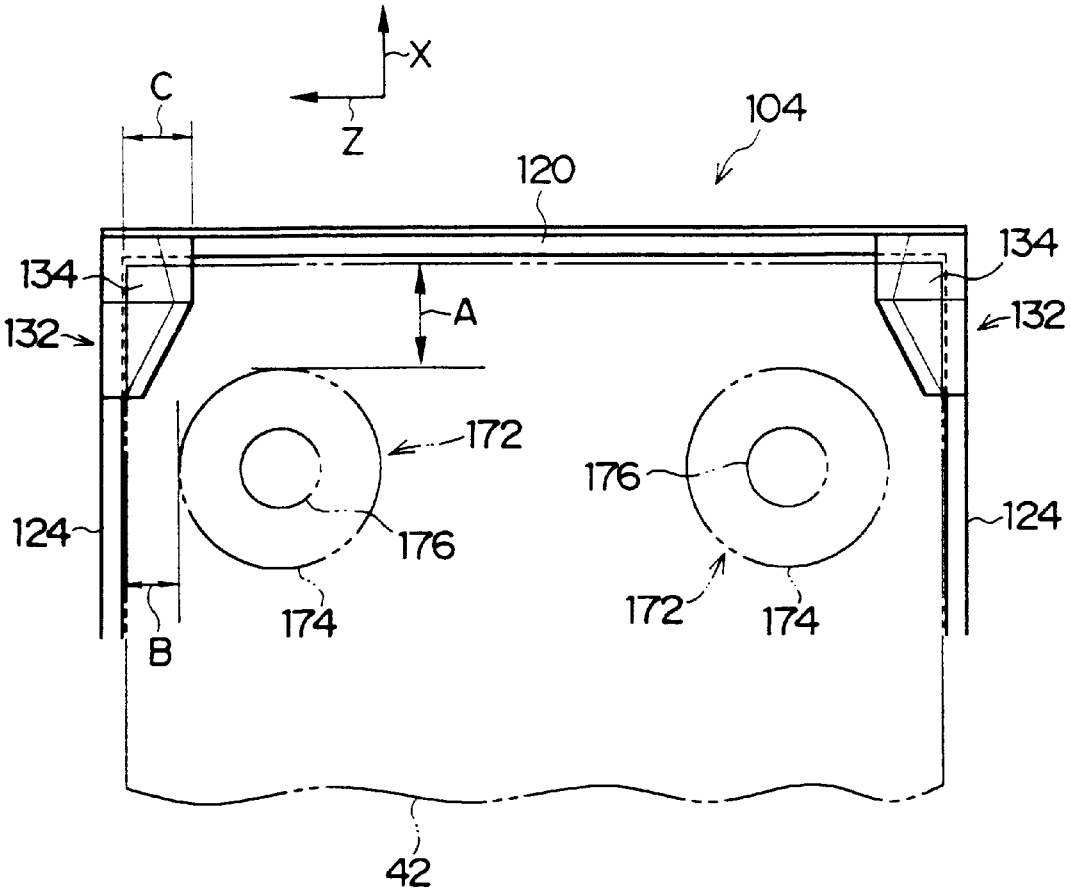
FIG. 6 is a top plan view for showing a position of an engagement claw and a position of an adsorbing unit.
Figure 15:
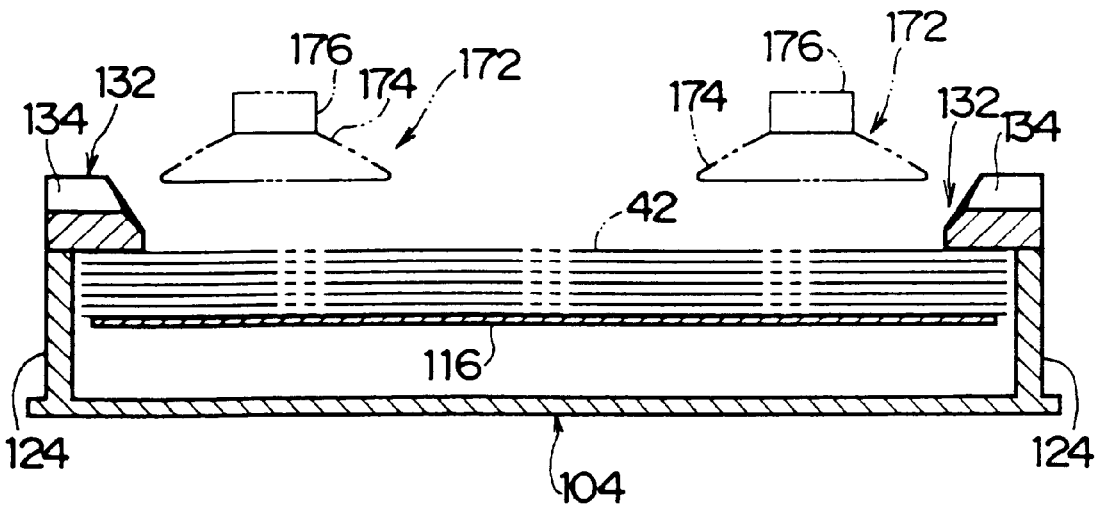
FIG. 15 is a front cross-sectional view of a tray for showing the state of the material to be adsorbed, the push-up unit and the sucker in the initial state (in the state of FIG. 10).

Further, at the upper end portions of the side walls 120 and 124, a pair of engagement claws 132 are provided to correspond to the front side corner portions of the tray 104. These engagement sections 132 stretch out from the upper end portions of the side walls 124 to the inside in the width direction, with a gradually narrower width toward the back side. In this case, as shown in FIG. 6, a size C between the inside end portion in the width direction of each engagement claw 132 and the inside surface of the side wall 124 is set at approximately 7 mm. As shown in FIG. 15, these engagement claws 132 are brought into contact with the corner portions of the front end side of the image receiving material 42 on the push-up panel 116 pushed up by the spring force of the spring 130, so that the image receiving material 42 is sandwiched between the push-up panel 116 and the engagement claws 132. Sloped surfaces 134 with a gradually upward slope toward the front end are formed on the upper end portions of these engagement claws 132.

Figure 10:
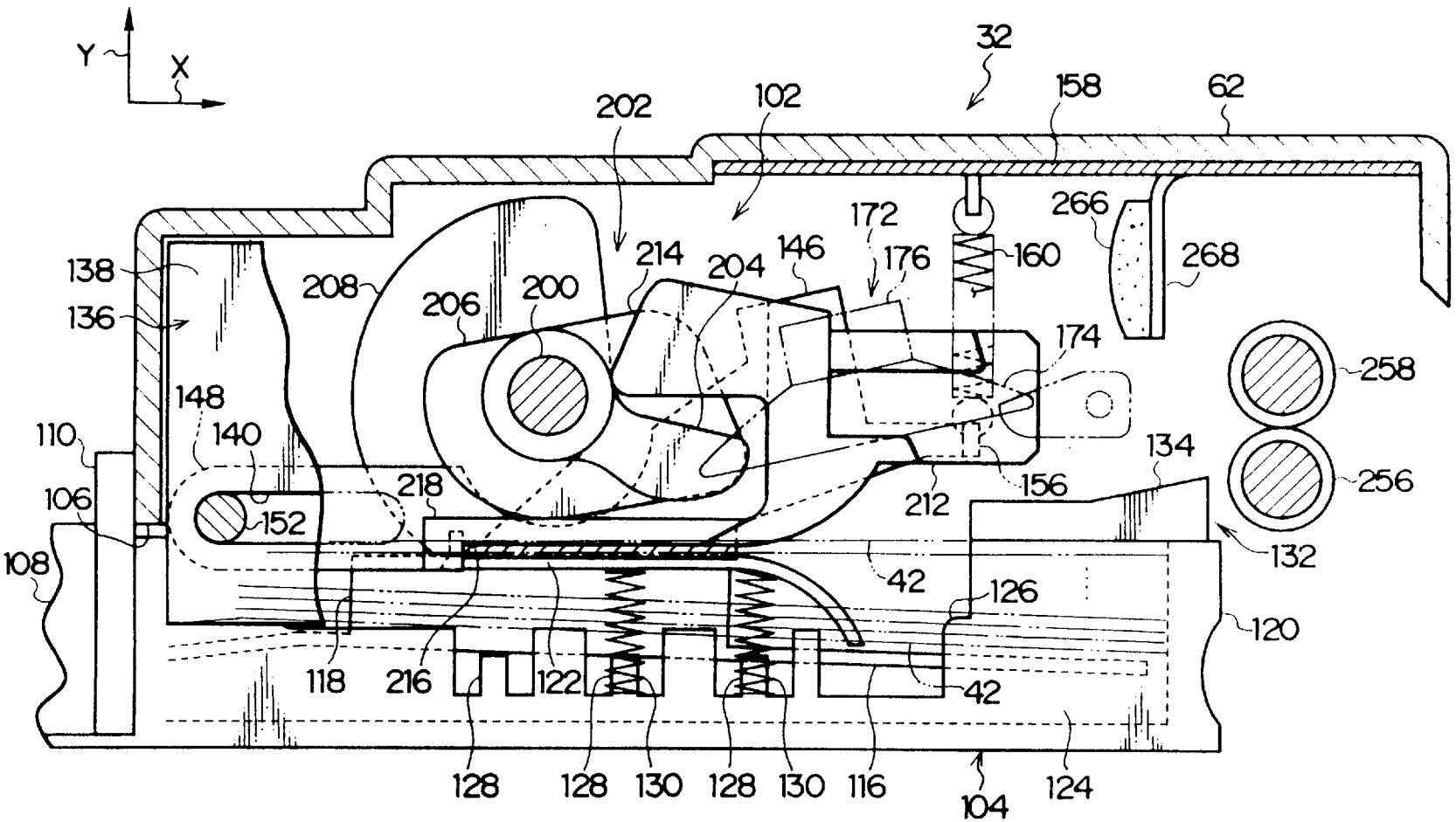
FIG. 10 is a side cross-sectional view in an initial state of a supplying unit for a material to be adsorbed relating to one mode implementation of the present invention.

On the other hand, as shown in FIG. 1, the sheet feeding section main body 102 has a frame 136 having its ceiling section 158 fixed to the cover 62 by a fixing unit such as a bolt or the like (not shown). From both end portions in the width direction of the ceiling section 158 of this frame 136, side walls 138 as shown in FIG. 10 are extended to the downward direction. As shown in FIGS. 1 and 10, both side walls 138 are formed with long holes 140 extended in the forward and backward directions. Also, as shown in FIG. 2, inside each side wall 138, there are provided a pair of swinging arms 148 and 150, integrally formed by having their back end sides linked with a rotary axis 152. In this case, as shown in FIGS. 7 and 10, each rotary axis 152 enters each long hole 140, and the swinging arms 148 and 150 (only the swinging arm 148 is shown in FIG. 10) can rotate around the rotary axis 152 and can also move in the forward and backward directions along the long hole 140.

Figure 7:
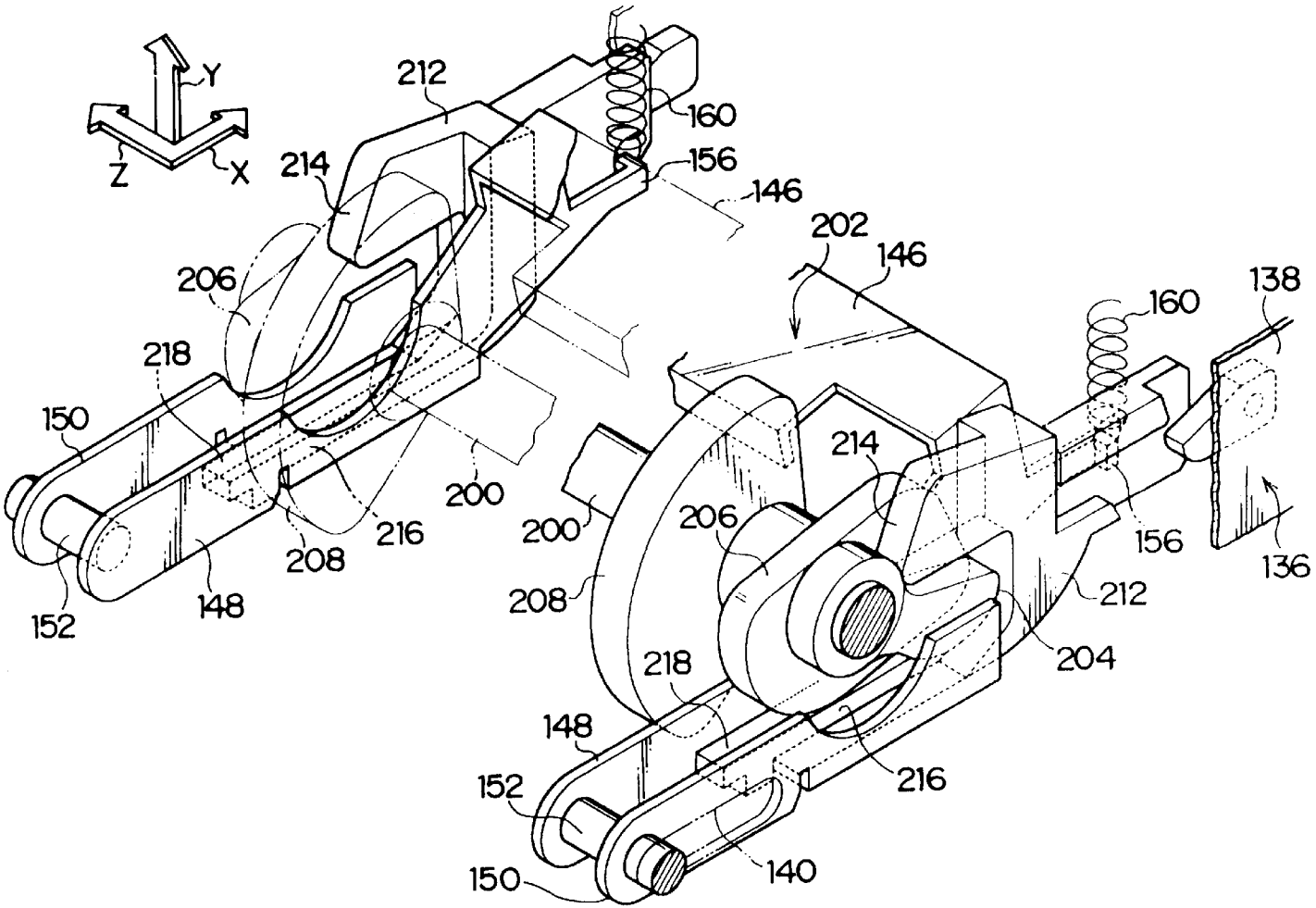
FIG. 7 is a perspective vie of a cam to be used for moving the sucker and for pressing down a push-up unit.

Further, as shown in FIG. 7, the front end side of the swinging arm 148 is extended upward in a slope, and the front end portion is formed with a spring fitting section 156 in projection. As shown in FIG. 10, one end portion of a spring 160 is fixed to the spring fitting section 156, with the other end portion fixed to the ceiling section 158. The swinging arm 148 is always pressed upward by the spring force of the spring 160.

Further, as shown in FIG. 7, the upper end of the front end portion of each swinging arm 148 is linked with a panel-shaped connecting section 146 bridged along the width direction above the tray 104, and is fitted with a sucker adsorbing unit 171.

Figure 4:
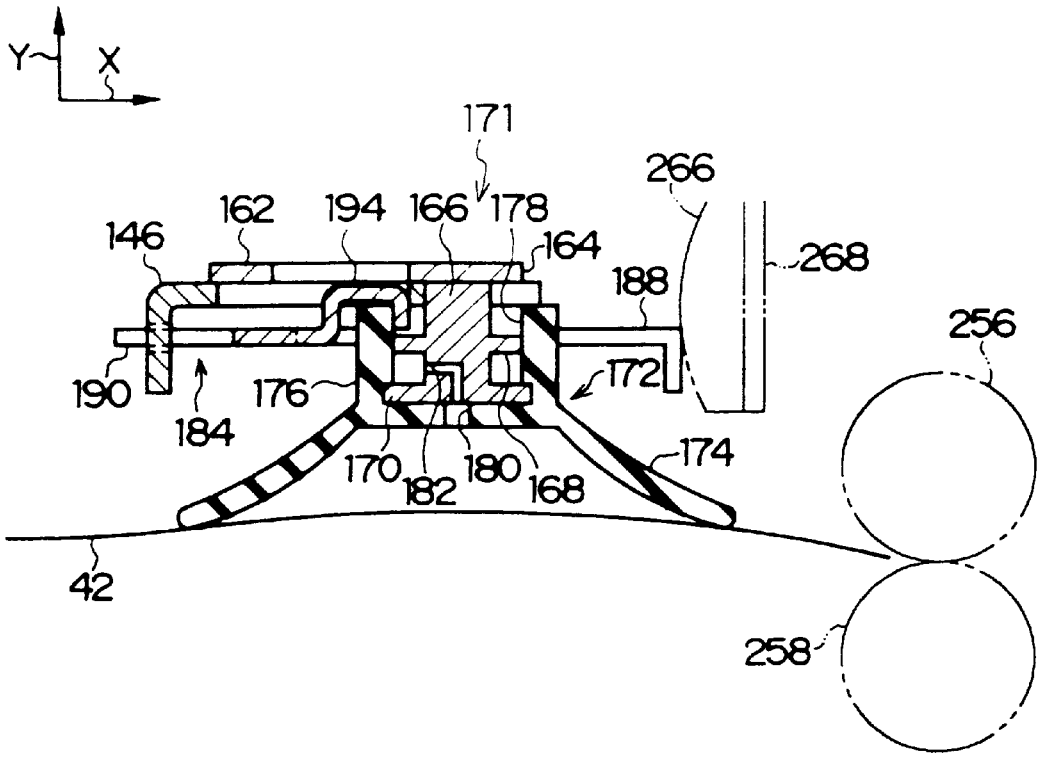
FIG. 4 is a cross-sectional view of a sucker adsorbing unit relating to one mode of implementation of the present invention.
Figure 8:
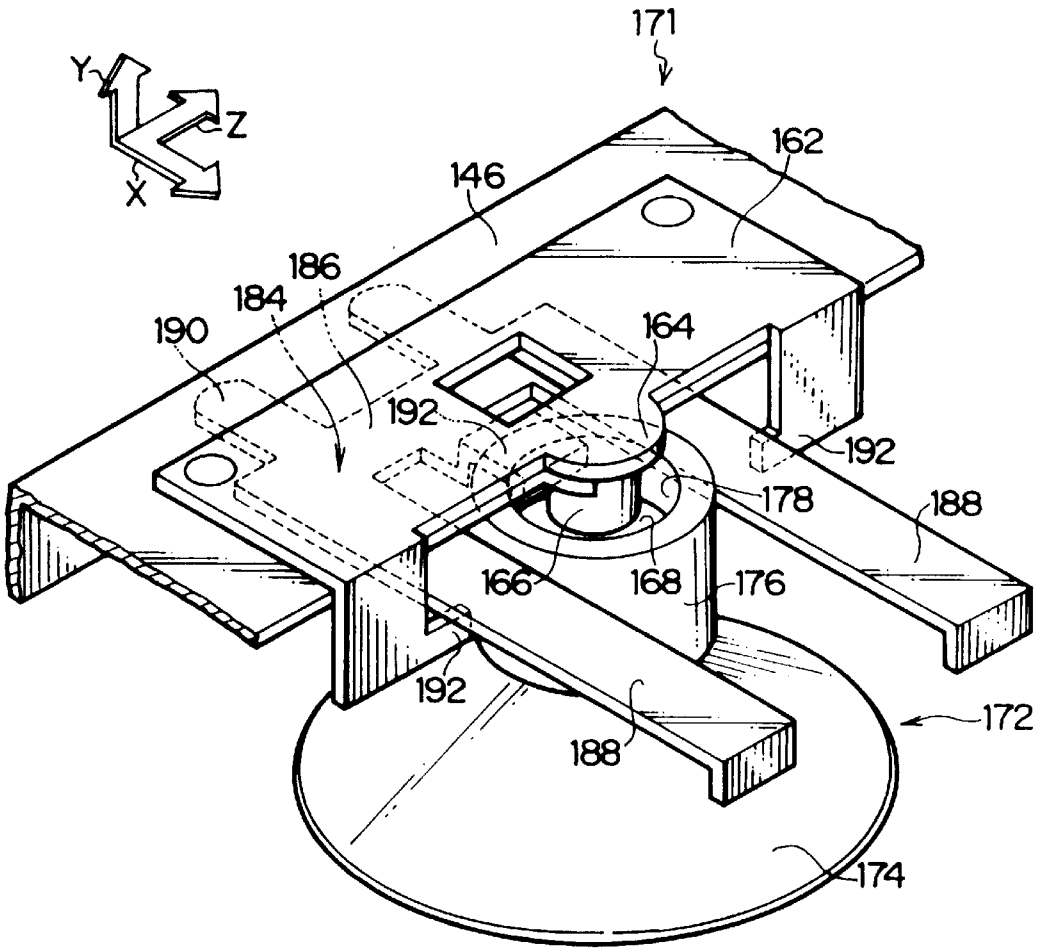
FIG. 8 is an enlarged perspective view of the sucker and its periphery.

As shown in FIG. 2, a pair of approximately panel-shaped supporting plates 162 are fixed at the upper side of the intermediate section in the longitudinal direction of the connecting section 146. A semi-circular-shaped projection section 164 is formed in projection at the front end portion of each supporting plate 162. As shown in FIGS. 4 and 8, a supporting member 166 for structuring the sucker adsorbing unit 171 is fixed to the lower surface of each projection section 164. This supporting member 166 has an overall circular cylindrical shape, and is formed with flange sections 168 and 170 stretching toward the outside in the diameter direction at the intermediate section and the bottom end portion of the axial direction respectively, as shown in FIG. 4. This supporting member 166 is fitted with a sucker 172 formed by an elastic and flexible resin material or rubber.

As shown in FIG. 4, the sucker 172 has an umbrella section (an adsorbing umbrella section) 174 having a diameter of approximately 20 mm in the normal state. This umbrella section 174 has a thickness of about the same size and is formed in concave in the downward direction. When the opening portion of the umbrella section 174 is in the state of being pressed against the image receiving material 42, the umbrella section 174 is elastically deformed, and a negative pressure is generated inside this umbrella by the restoring force so that the image receiving material 42 can be adsorbed.

At the upper end portion of the umbrella section 174, a supporting section 176 is formed integrally. This supporting section 176 is formed with a supporting hole 178 having a bottom for forming a through-hole open to the upward. The supporting hole 178 is a circular hole slightly smaller than the flange sections 168 and 170 of the supporting member 166. The supporting member 166 enters inside the supporting hole 178 and the flange section 170 enters an extended diameter section of the bottom of the supporting hole 178, so that the sucker 172 is supported by the supporting member 166.

Further, a piercing hole 180 for structuring a through-hole of the diameter of about 0.5 mm is formed at the core axis portion at the bottom of the supporting hole 178. Through this hole 180, the supporting hole 178 is connected with the inside of the umbrella section 174. In this case, in the supporting member 166, there is formed a piercing hole 182 for structuring a through-hole of which one end is open at the bottom of the supporting member 166, the intermediate portion is bent and the other end is open on the peripheral surface of the supporting member 166 between the flange section 168 and the flange section 170. One end of this piercing hole 182 is connected with the piercing hole 180 in the state that the sucker 172 is supported by the supporting member 166. However, in the normal state, the inside of the supporting hole 178 connecting to the piercing hole 182 is closed by the flange section 168. Therefore, even if a negative pressure is generated inside the umbrella section 174, the external air will never enter the inside of the umbrella section 174 through the supporting hole 178 and the piercing holes 180 and 182.

Further, as shown in FIG. 6, each sucker 172 is positioned at approximately 7 mm from the inner-side surface of the side wall 120 of the tray 104 to the outer periphery of the umbrella section 174 as a size A and at approximately 8 mm from the inner-side surface of the side wall 124 of the tray 104 to the outer periphery of the umbrella section 174 as a size B. These size values and a projection size C of the engagement claw 132 are the values obtained based on experiments carried out in order to confirm the performance of the adsorption of each sucker 172 when the sucker adsorbs the image receiving material 42 and the performance of smooth disengage ability of the image receiving material 42 from the engagement claw 132 when each sucker 172 lifts the image receiving material 42 in the adsorbed state. It has been confirmed by the experiments that these size values are the optimum even if the size of the image receiving material 42 and the thickness of the image receiving material 42 are changed. Although the fitting position of each sucker 172 has been set at the above-described values in the present mode of implementation, it is also good to fit each sucker 172 at other position with size values other than the above-described values by taking various conditions of fitting positions of other parts into consideration.

On the other hand, as shown in FIGS. 4 and 8, at the lower side of each connection section 146, there is provided a sucker pressing member 184 for structuring a cancelling unit of the sucker adsorbing unit so as to be opposed to the supporting plate 162 through the connection section 146. As shown in FIG. 2, these sucker pressing members 184 are provided to correspond to each sucker 172, and have a base section 186 having a long side in the width direction of the tray 104. This base section 186 is provided at the back side of the supporting section 176 of the sucker 172 and has a pair of arms 188 toward the forward direction from both end portions of the longitudinal direction.

In this case, each supporting plate 162 is formed with a supporting section 192 for supporting each arm 188, as shown in FIG. 8. This supporting section 192 extends downwards from the front end portion of the supporting plate 162, with its lower end side further extending toward the width direction, to support the arm 188 from below.

Figure 5:
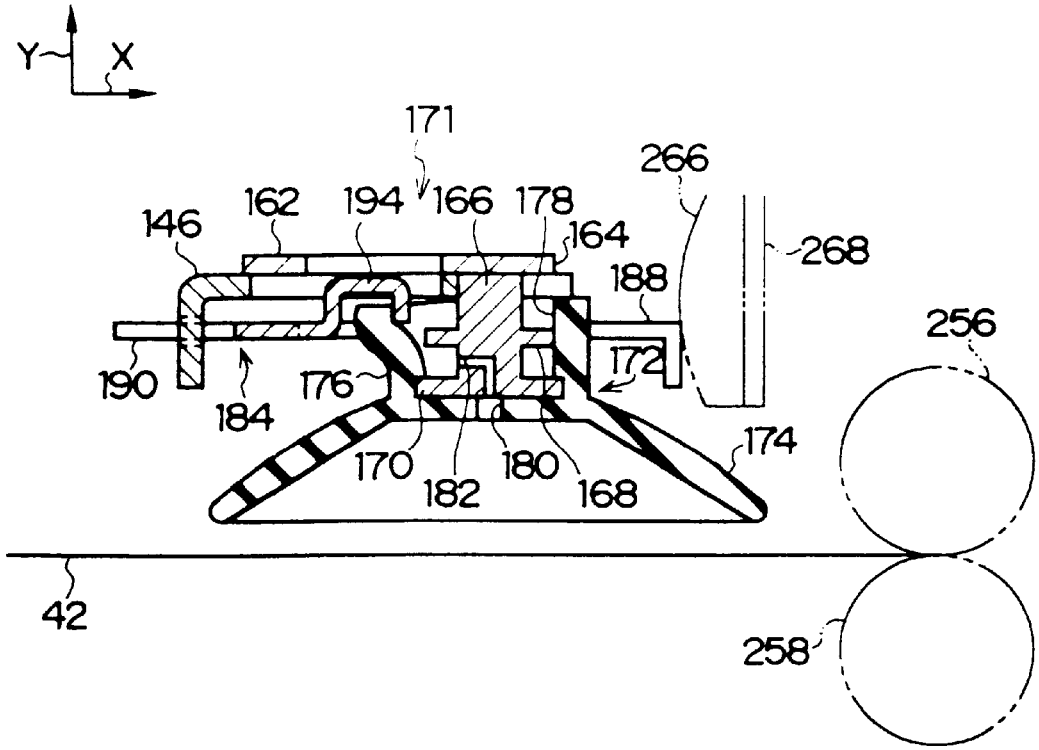
FIG. 5 is a cross-sectional view of the sucker adsorbing unit shown in FIG. 4 for showing the state that an adsorption by the sucker is cancelled.

Further, an arm 190 extends backwards from a slightly inner side section of both end portions in the longitudinal direction of the base section 186. Also, a lever 194 extends toward the front side from the center in the longitudinal direction of the base section 186. As shown in FIG. 4, the front end side of the lever 194 is bent in a U-shape corresponding to the supporting section 176 of the sucker 172. Further, the front end portion enters the supporting hole 178 of the supporting section 176 from above and is brought into contact with the inner periphery of the supporting hole 178. Accordingly, as shown in FIG. 5, when the sucker pressing member 184 is moved backwards relative to the sucker 172, the lever 194 pulls the supporting hole 178 of the sucker 172 to elastically deform the supporting hole 178. With this deformation, there is generated a gap between the inner periphery of the supporting hole 178 and the flange section 168 of the supporting member 166, so that the negative pressure inside the umbrella section 174 is cancelled.

Further, one end of the spring 196 is stopped at the center of the connection section 146. The other end of the spring 196 is fixed to the ceiling section 158 of the frame 136 at the rear side of the connection section 146, thus always pressing the connection section 146 backwards.

Further, as shown in FIGS. 1 and 2, a rotary axis 200 is disposed at the rear side of the sucker 172. As shown in FIG. 2, the rotary axis 200 has a longitudinal side in the width direction of the tray 104, and its both end sides are axially supported rotatably to both side walls 138. Further, as shown in FIGS. 1 and 7, cams 202 are provided at both end sides of the rotary axis 200. Each cam 202 is formed with a first cam section 204, a second cam section 206 and a third cam section 208, each having a different shape.

Figure 14:
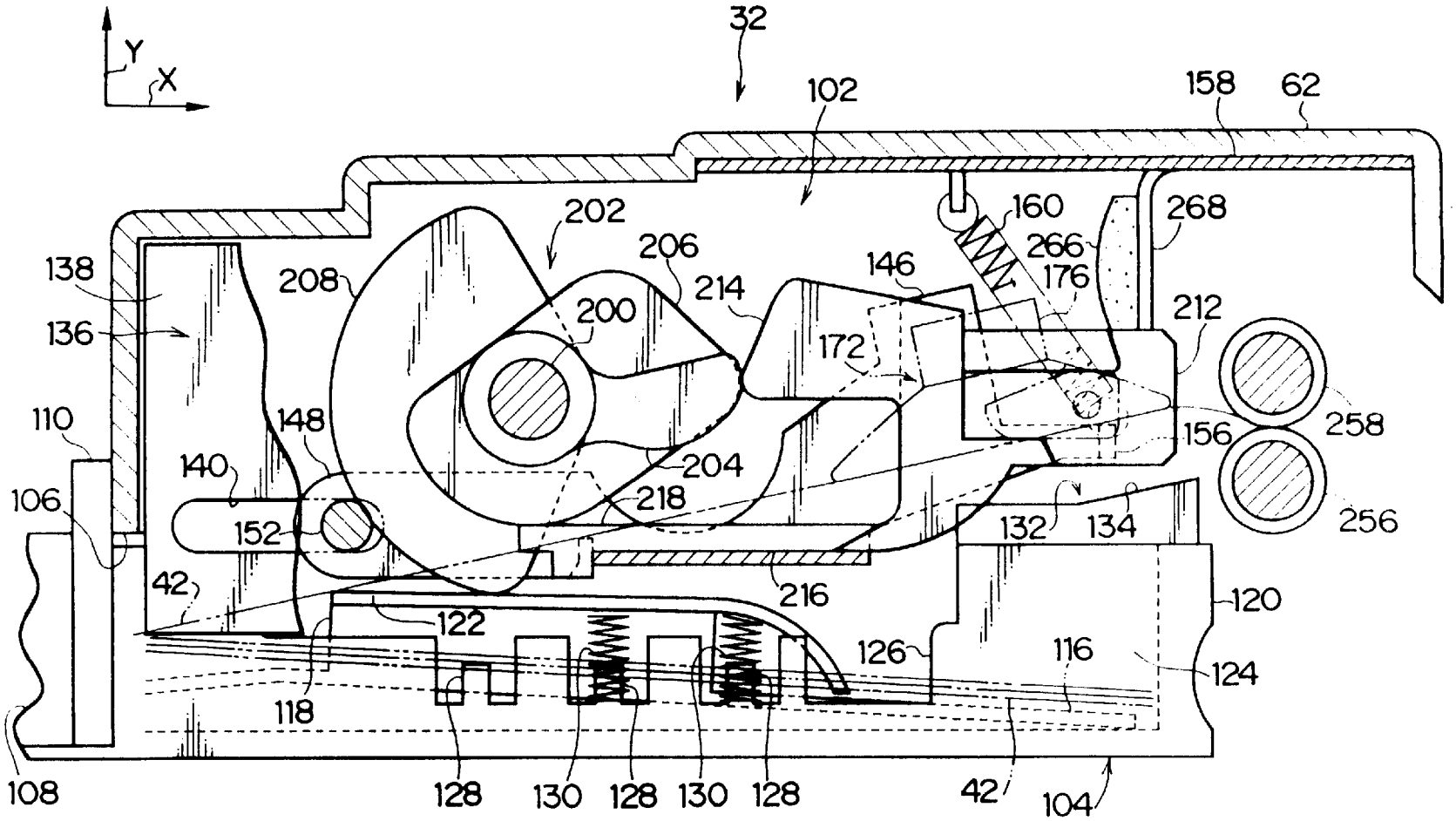
FIG. 14 is a side cross-sectional view corresponding to FIG. 10 for showing a position of the sucker in the state that the sucker has come close to a carrying roller in the state that the CUM has adsorbed the material to be adsorbed.

The first cam section 204 is formed at the outermost side in the axial direction of the cam 202, and is rotated to a predetermined position to press an end surface 214 at the back side of a cam follower 212 so that the swinging arm 148 moves forwards against the resilient force of the spring 196 (reference FIG. 14).

On the other hand, the second cam section 206 is formed adjacent to the inner side in the axial direction of the first cam section 204. This second cam section 206 is brought into contact with an upper end surface 218 of a rod section 216 (reference FIG. 7) extended backwards from the lower end portion of the inner side portion of the end surface 214 of the cam follower 212 by the resilient force of the spring 160. When the second cam section 206 rotates, the rod section 216 (that is, the cam follower 212) moves upwards and downwards along the outer periphery of the second cam section 206, and further, the swinging arm 148 moves upwards and downwards (reference FIGS. 11 to 13).

Further, the third cam section 208 is formed at the inner side in the axial direction of the second cam section 206. In this case, as shown in FIG. 3, the third cam section 208 has its outer periphery opposed to the upper surface of the bend portion 122 of the push-up panel 116, and, when reaching a predetermined position, the third cam section 208 pushes down the push-up panel 116 through the bent section 122 against the resilient force of the spring 130 (reference FIGS. 11 and 16).

Further, as shown in FIG. 2, one end side (an arrow Z direction side) of the rotary axis 200 stretches out from the side wall 138, and enters inside a gear box 202 provided adjacent to the side wall 138.

Inside the gear box 220, a plurality of gears 222, 223, 224, 225, 226, 227, 228, 229, 230 and 232 for structuring a first gear string are axially supported in a sequentially meshed state. At the same time, the gear 232 is coaxially connected to the rotary axis 200 through a one-way clutch 238.

The one-way clutch 238 transmits a rotation of a predetermined direction of the gear 232, that is, a clockwise direction of the one-way clutch 238 and the gear 232 as viewed from the arrow Z direction shown in FIG. 10, to the rotary axis 200 to rotate the rotary axis 200. Hereinafter, the clockwise direction viewed from the arrow Z direction as shown in FIG. 10 will simply be referred to as "a clockwise direction" and a direction opposite to this will be referred to as "a counter-clockwise direction". The rotation of the gear 232 in the counter-clockwise direction is not transmitted to the rotary axis 200. As the one-way clutch 238, there is applied a socalled sprag clutch which is provided, for example, with a number of sprags having a special shape such as a cocoon shape between an external wheel integrally fitted to the inner periphery of the gear 232 and an internal wheel integrally fitted to the outer periphery of the rotary axis 200. This sprag clutch transmits the rotation of the external wheel (that is, the gear 232) to the internal wheel (that is, the rotary axis 200) by the operation of the beam formed by these sprags. It is also good to use a one-way clutch of other structure without being limited to this sprag clutch. The same also applies to one-way clutches 262 and 264 to be described later.

Further, as shown in FIG. 2, there is disposed a motor 240 as a driving unit at the side of the gear box 220 (at the arrow Z side) . The motor 240 is connected to a switch (not shown) provided in the base 12 through a control circuit (not shown) as a control unit. The motor 240 has its output axis 242 projected to the inside through the gear box 220, and a gear 244 is integrally fitted to the front end portion of the output axis 242. The gear 244 is meshed with the gear 222. When a power is supplied to the motor 240 to drive the motor 240 and when the output axis 242 rotates, the gears 222 to 232 sequentially decelerate the turning effort of the output axis 242 at a predetermined reduction gear ratio, and further transmit the turning effort of the output axis 242 to the rotary axis 200 through the one-way clutch 238 to rotate the rotary axis 200.

Figure 9:
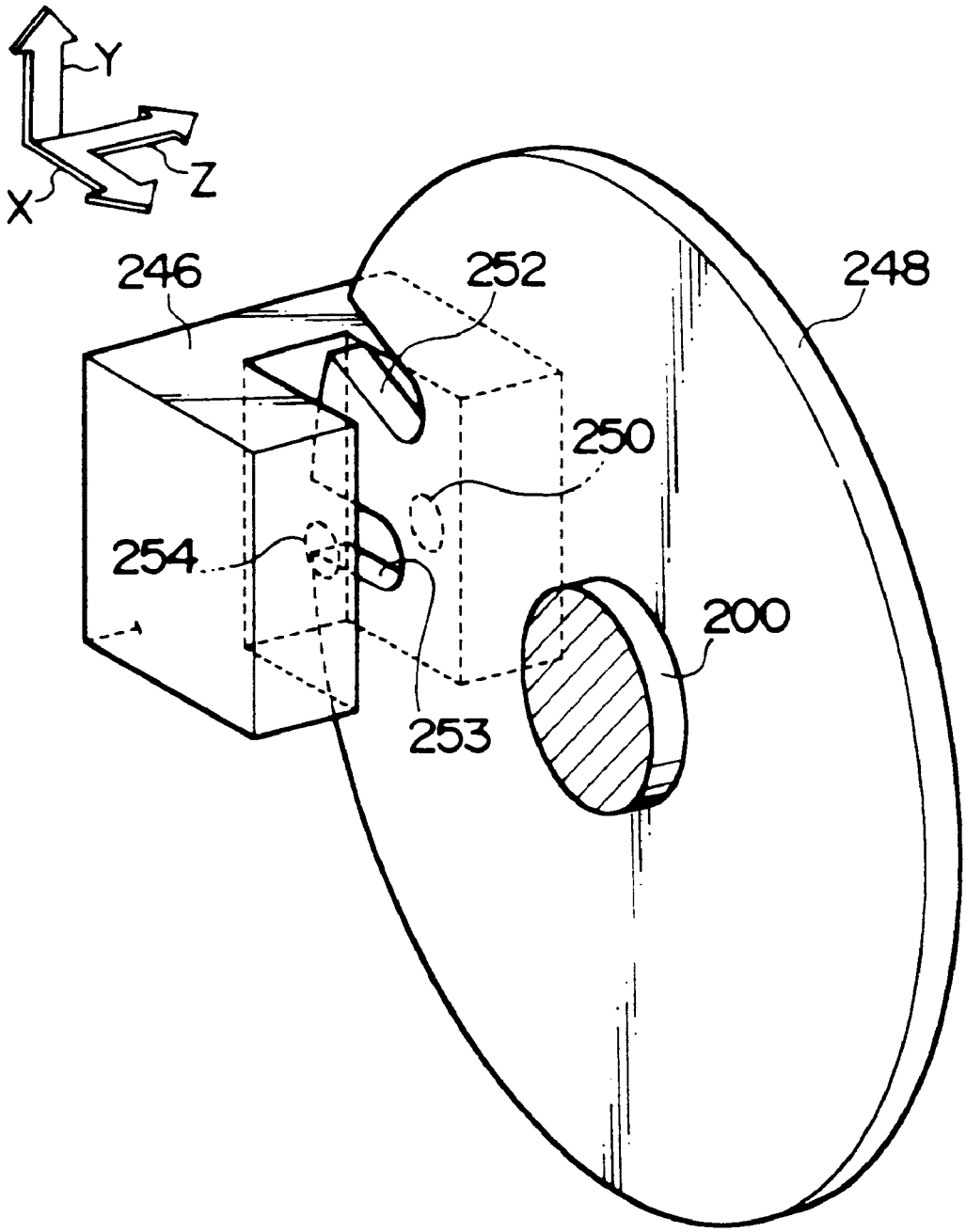
FIG. 9 is a perspective view of a photo-interrupter and a cam plate.

Further, as shown in FIG. 2, there is disposed a photo-interrupter 246 inside the gear box 220. The photo-interrupter 246 is disposed to sandwich a part of the outer periphery of a disc-shaped rotary disc 248 integrally fitted to the rotary axis 200 at the side of the gear 232, and is connected to the motor 240 through the above-described control circuit. As shown in FIG. 9, when a light beam emitted from a light emitting device 250 of the photo-interrupter 246 has been interrupted by the disc 248 rotating together with the rotary axis 200, the photo-interrupter 246 is set to an OFF state. When a light beam emitted from the light emitting device 250 has reached a light receiving device 254 through a recess 252 or 253 formed on the disc 248, the photo-interrupter 246 is set to an ON state. With this arrangement, the rotation position of the cam 202 is detected, that is, the rotation positions of the first to the third cams 204, 206 and 208 are detected, and a signal is sent to the control circuit to drive the motor 240 in the forward direction or the reverse direction or stop the motor 240 according to the rotation position of the cam 202.

On the other hand, as shown in FIG. 1, a pair of carrying rollers 256 and 258 are provided to face each other in the upward and downward directions, in front of the sucker 172. In this case, as shown in FIG. 2, the carrying roller 256 has its axial direction parallel with the axial direction of the rotary axis 200, and the both end sides of the carrying roller 256 are axially supported rotatably to both side walls 138. The both end sides of the carrying roller 256 stretch to the outside of each side wall 138, and a gear 260 is fixed to the portion stretched from each side wall 138. The gear 260 is meshed with a gear (not shown) of a roller 272 provided at the lower side of the carrying roller 256 shown in FIG. 1, so that the roller 272 rotates by receiving a turning effort of the carrying roller 256 and then the endless belt 36 keeping in contact with the roller 272 rotates (runs)

On the other hand, the carrying roller 258 is disposed at the upper side of the carrying roller 256 and is always pressed to the direction approaching the carrying roller 256 by nip springs 270 provided on both end sides of the carrying roller 256. Accordingly, in the state that the carrying roller 258 is in contact with the carrying roller 256, the carrying roller 258 rotates by receiving the turning effort of the carrying roller 256. Further, in the state that the image receiving material 42 is sandwiched between the carrying rollers 256 and 258, the carrying roller 258 rotates by a friction force generated by the friction with the image receiving material 42 which is being sent by receiving the turning effort of the carrying roller 256.

Further, at the side of the gear box 220 of the carrying roller 256, gears 234 and 236, each having the same number of teeth, are coaxially fitted to the carrying roller 256 through one-way clutches 262 and 264 respectively.

The gear 234 is meshed with the gear 227, to structure a second gear string together with the gears 222, 223, 224, 225, 226, 227. The gear 236 is meshed with the gear 224 to structure a third gear string together with the gears 222, 223 and 224. In other words, the gears 222 to 224 form not only the parts of the first gear string but also the parts of the second and third gear strings respectively, and the gears 226 and 227 also form not only the parts of the first gear string but also the parts of the third gear string. Accordingly, when the output axis 242 comes to rotate by the driving of the motor 240, not only the rotary axis 200 rotates but also the gear 234 rotates through the gears 222 to 227 and the gear 236 rotates through the gears 222 to 224.

In this case, the one-way clutches 262 and 264 transmit the rotation in the clockwise direction of the gears 234 and 236 to the carrying roller 256 to rotate the carrying roller 256, but do not transmit the rotation in the counter-clockwise direction of the gears 234 and 236 to the carrying roller 256. Accordingly, when the output axis 242 has rotated in the arrow D direction in FIG. 2 (that is, the forward rotation: the clockwise rotation of the output axis 242), the gear 236 rotates in the counter-clockwise direction through the gears 222 to 224. However, the rotation force of the gear 236 is not transmitted to the carrying roller 256 by the one-way clutch 264, but only the turning effort of the gear 234 rotating in the clockwise direction through the gears 222 to 227 is transmitted to the carrying roller 256 through the one-way clutch 262.

On the other hand, when the output axis 242 has rotated in the arrow E direction in FIG. 2 (that is, the reverse rotation: the counter-clockwise rotation of the output axis 242) , the gear 234 rotates in the counter-clockwise direction through the gears 222 to 227. However, the rotation force of the gear 234 is not transmitted to the carrying roller 256 by the one-way clutch 262, but only the turning effort of the gear 236 rotating in the clockwise direction through the gears 222 to 224 is transmitted to the carrying roller 256 through the one-way clutch 264.

Further, although the number of teeth is the same for both the gear 234 and the gear 236, since the gear 234 is connected to the gear 224 through the gears 227, 226 and 225, and also since the rotation of the gear 224 is transmitted to the gear 234 by being decelerated by the gears 225 to 227 at a predetermined reduction gear ratio, the rotation velocity of the carrying roller 256 during a reverse rotation of the output axis 242 becomes faster than the rotation velocity of the carrying roller during a forward rotation of the output axis 242 even if the rotation velocity of the output axis 242 is the same during both the forward and reverse rotations.

Further, in this case, the reduction gear ratio of the gears 222 to 228 is set such that when the motor 240 has been driven to rotate in the forward direction, the peripheral velocity of the carrying roller 256 becomes smaller than the velocity at which the second cam section 206 of the cam 202 presses the cam follower 212 to move forward the swinging arm 148 (that is, the sucker 172).

Further, as shown in FIG. 10, a pressing member 266 that structures the cancelling unit of the sucker adsorbing unit is provided between the carrying roller 256 and the sucker 172. The pressing member 266 is provided for each sucker 172, is fixed to a bent section 268 which is a part of the ceiling section 158 of the frame 136 bent downward, and is opposed to the front end portion of the arm 188 of the sucker pressing member 184. Each of the pressing members 266 is brought into contact with the front end portion of the arm 188 of the sucker pressing member 184 by close approaching of the sucker 172 to the carrying rollers 256 and 258, as shown in FIG. 4. Further, as shown in FIG. 5, when the sucker 172 makes a further movement, the pressing member 266 presses the arm 188 to move the sucker pressing member 184 to the backward of the sucker 172. With this operation, the lever 194 expands the supporting hole 178 of the supporting section 176 of the sucker 172.

According to the image recording apparatus 10 of the above-described structure, the photo-sensitive material 24 is drawn from the supplying magazine 22 onto the stage 20 by a predetermined length by the rotation of the winding magazine 26 in the state shown in FIG. 21. An image of the draft is exposed by the exposing unit 28 onto the photo-sensitive material 24 positioned on the stage 20.

Next, when the motor 240 has started the driving for a forward rotation, the output axis 242 rotates in the clockwise direction, then the carrying roller 256 starts a rotation in the clockwise direction through the second gear string consisting of the gears 222 to 227 and 234, and the cam 202 starts a rotation in the clockwise direction through the first gear train consisting of the gears 222 to 232. In this case, when the output axis 242 rotates in the clockwise direction, the gear 236 rotates in the counter-clockwise direction through the gears 222 to 224 (that is, the third gear string). However, since there is the one-way clutch 264 between the gear 236 and the carrying roller 256, the turning effort of the gear 236 in the counter-clockwise direction will not be transmitted to the carrying roller 256.

Figure 11:
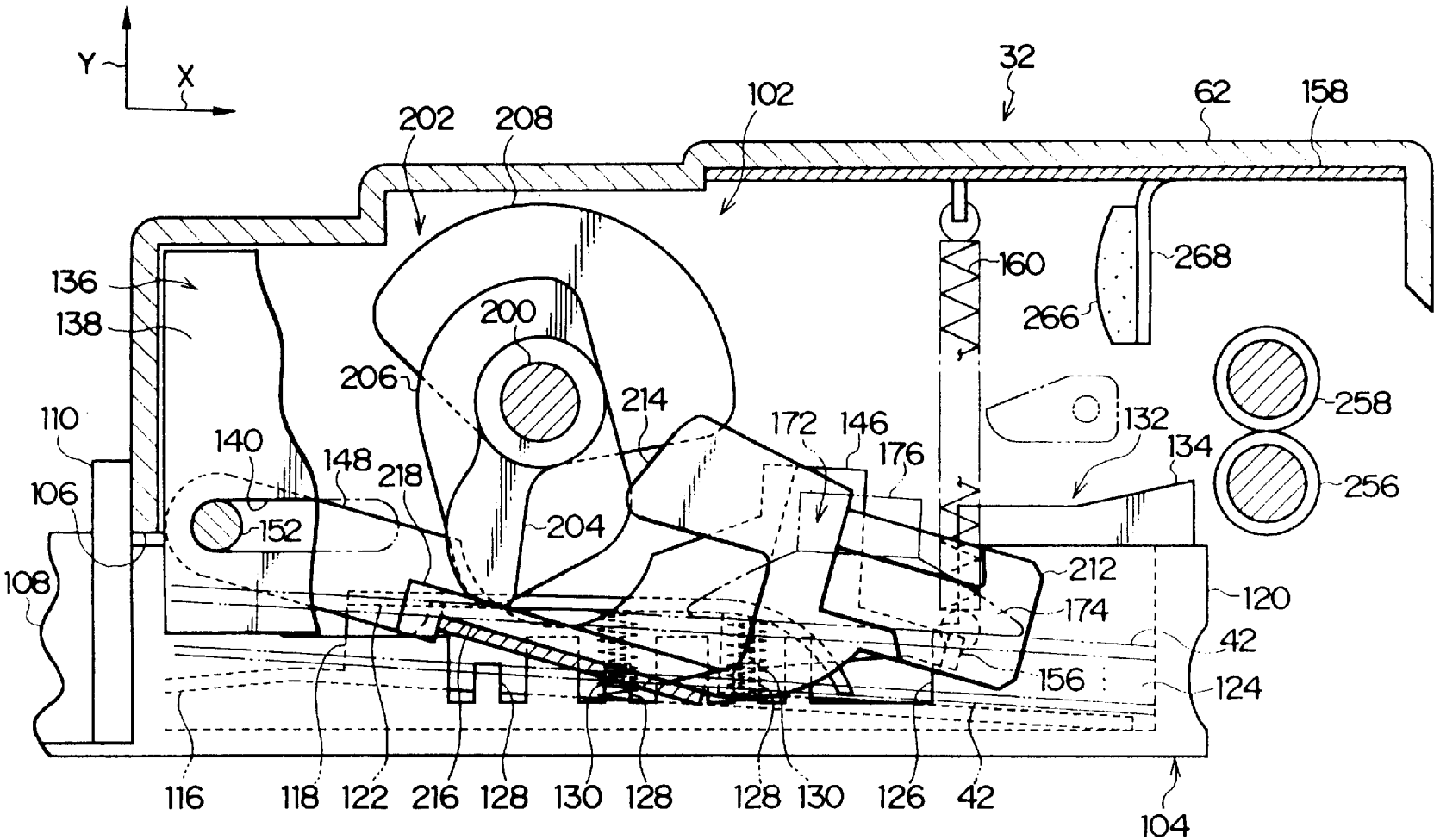
FIG. 11 is a side cross-sectional view corresponding to FIG. 10 for showing a position of a sucker in the state that the sucker has adsorbed the material to be adsorbed.
Figure 16:
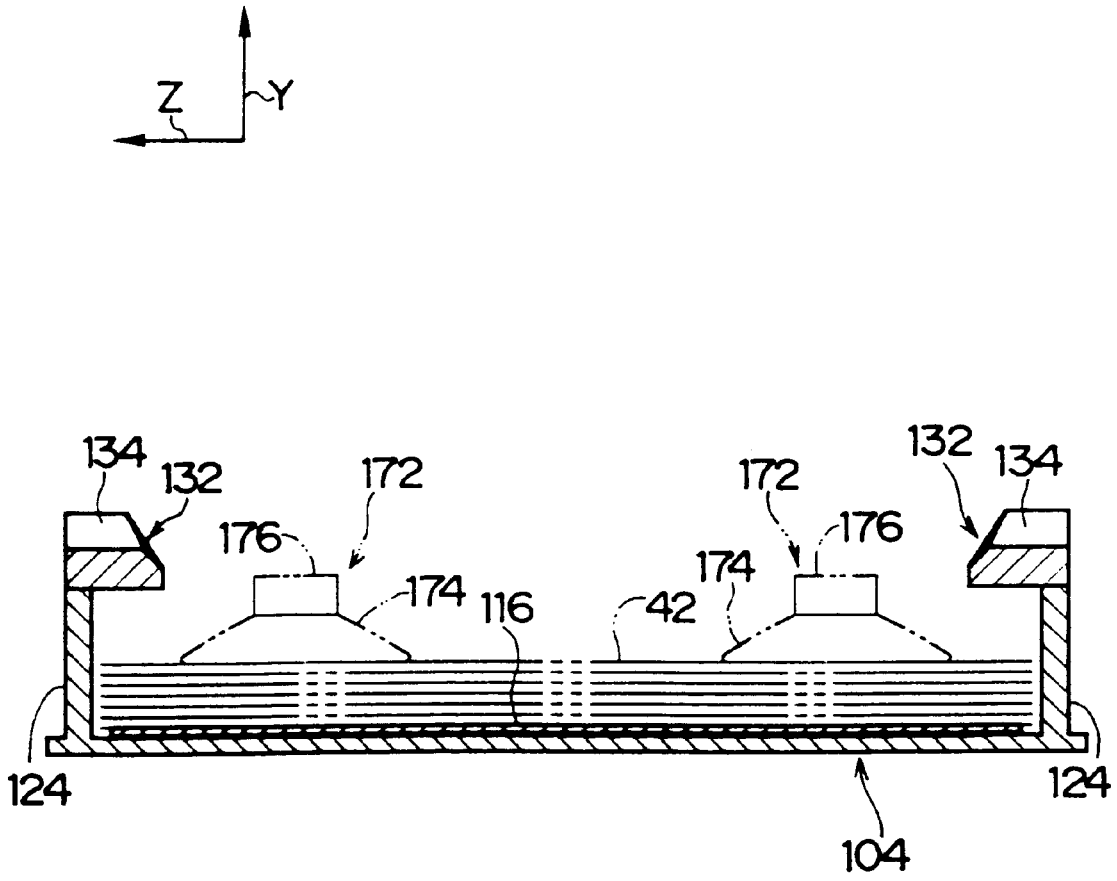
FIG. 16 is a front cross-sectional view of the tray for showing the state of the material to be adsorbed, the push-up unit and the sucker in the state of FIG. 11.

In this case, when the cam 202 at the state shown in FIG. 10 (that is, the initial state) is rotated to the state shown in FIG. 11, the radius from the rotation center of the second cam section 206 to the contact section of the cam follower 212 (that is, the upper end surface 218 of the rod 216) becomes longer, so that the swinging arm 148 is pressed downward around the rotary axis 152 against the resilient force of the spring 160. Accordingly, the suckers 172 positioned with a distance from the image receiving material 42 as shown in FIG. 15 are dropped onto the image receiving material 42 to press the surface (image-forming surface) of the top layer sheet of the image receiving material 42, as shown in FIG. 16. In this case, since the push-up panel 116 is pressed upward by the spring 130 shown in FIG. 10, the umbrella section 174 of the sucker 172 is elastically deformed by the pressing force applied by the drop of the swinging arm 148 and the resilient force of the spring 130, and a negative pressure is generated inside the umbrella section 174 by the restoring force. As a result, the top layer sheet of the image receiving material 42 is adsorbed by the umbrella section 174 of the sucker 172.

Figure 12:
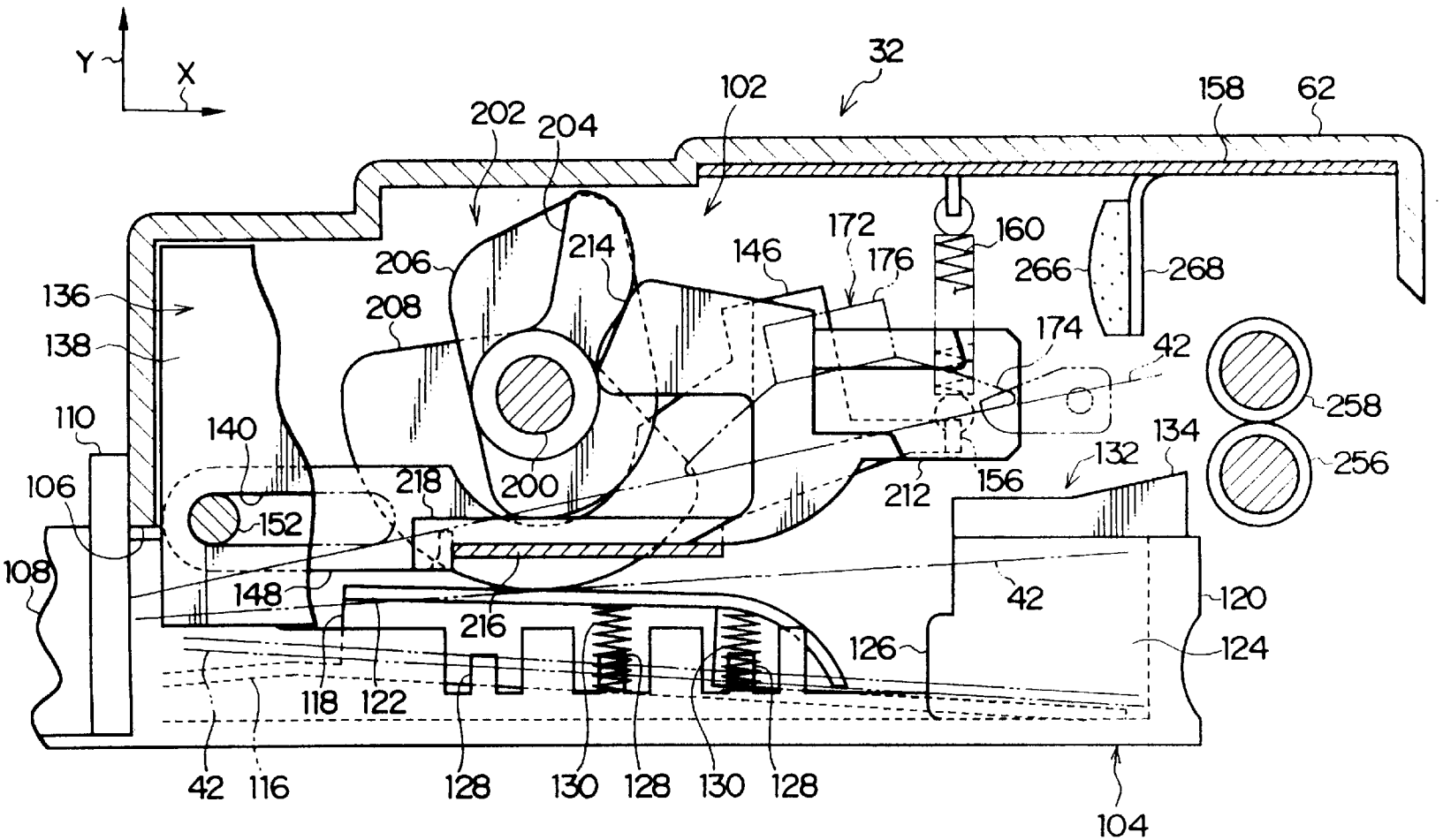
FIG. 12 is a side cross-sectional view corresponding to FIG. 10 in the state that a cancelling unit has pressed down the push-up unit.
Figure 17:
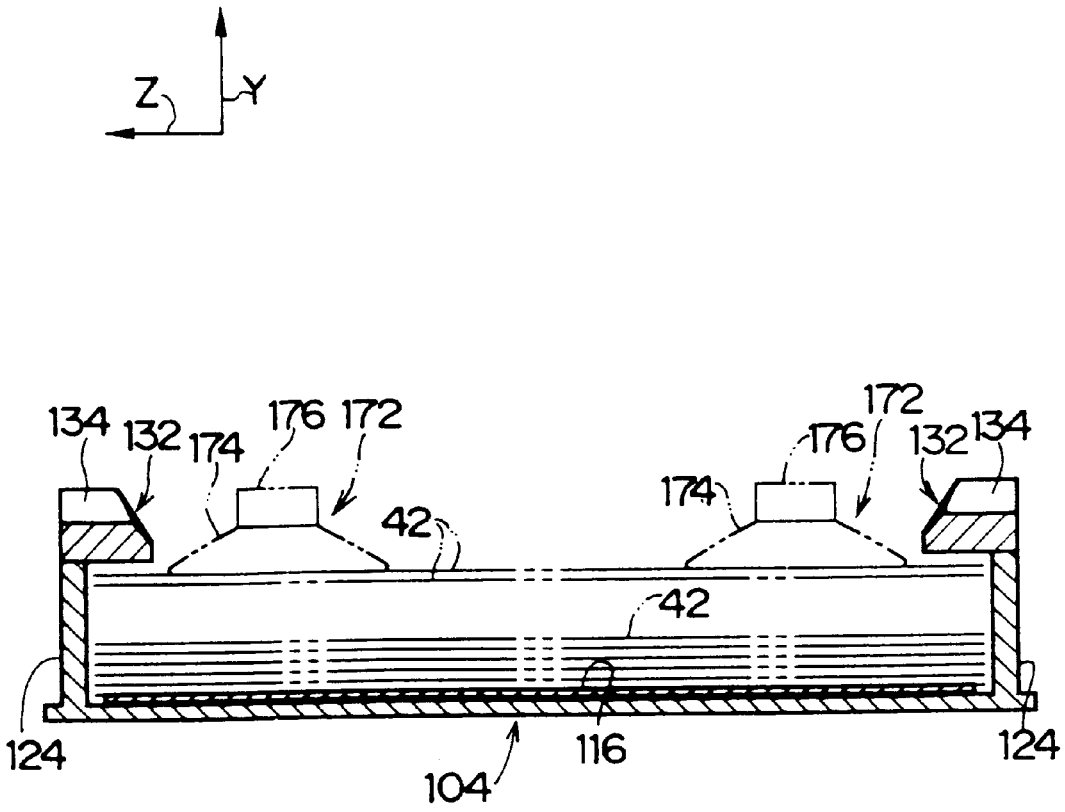
FIG. 17 is a front cross-sectional view of the tray for showing the state of the material to be adsorbed, the push-up unit and the sucker in the state of FIG. 12.

Next, when the cam 202 is rotated to the state shown in FIG. 12 from the state shown in FIG. 11, the radius from the rotation center of the second cam 206 to the contact portion of the cam follower 212 becomes smaller than the radius shown in FIG. 11, so that the swinging arm 148 moves upward by the resilient force of the spring 160. Thus, the top layer sheet of the image receiving material 42 adsorbed by the sucker 172 is lifted upward as shown in FIG. 17. Also, in this state, the third cam 208 presses down the bent section 122 of the push-up panel 116 against the resilient force of the spring 130. With this operation, the sandwiching state of the image receiving material 42 between the engagement claw 132 and the push-up panel 116 is cancelled, so that the rest sheets of the image receiving material 42 in the lamination below the top layer sheet of the image receiving material 42 are separated by their self-weight. However, since a coloring matter fixing material is coated on the surface of the image receiving material 42 with humidity, each sheet of the image receiving material 42 can easily adhere to the opposing sheet of the image receiving material 42. Accordingly, as shown in FIG. 17, even if the third and rest sheets of the image receiving material 42 are separated by their self-weight, there is also a case where the second sheet of the image receiving material 42 is adhered to the top layer sheet of the image receiving material 42.

Figure 13:
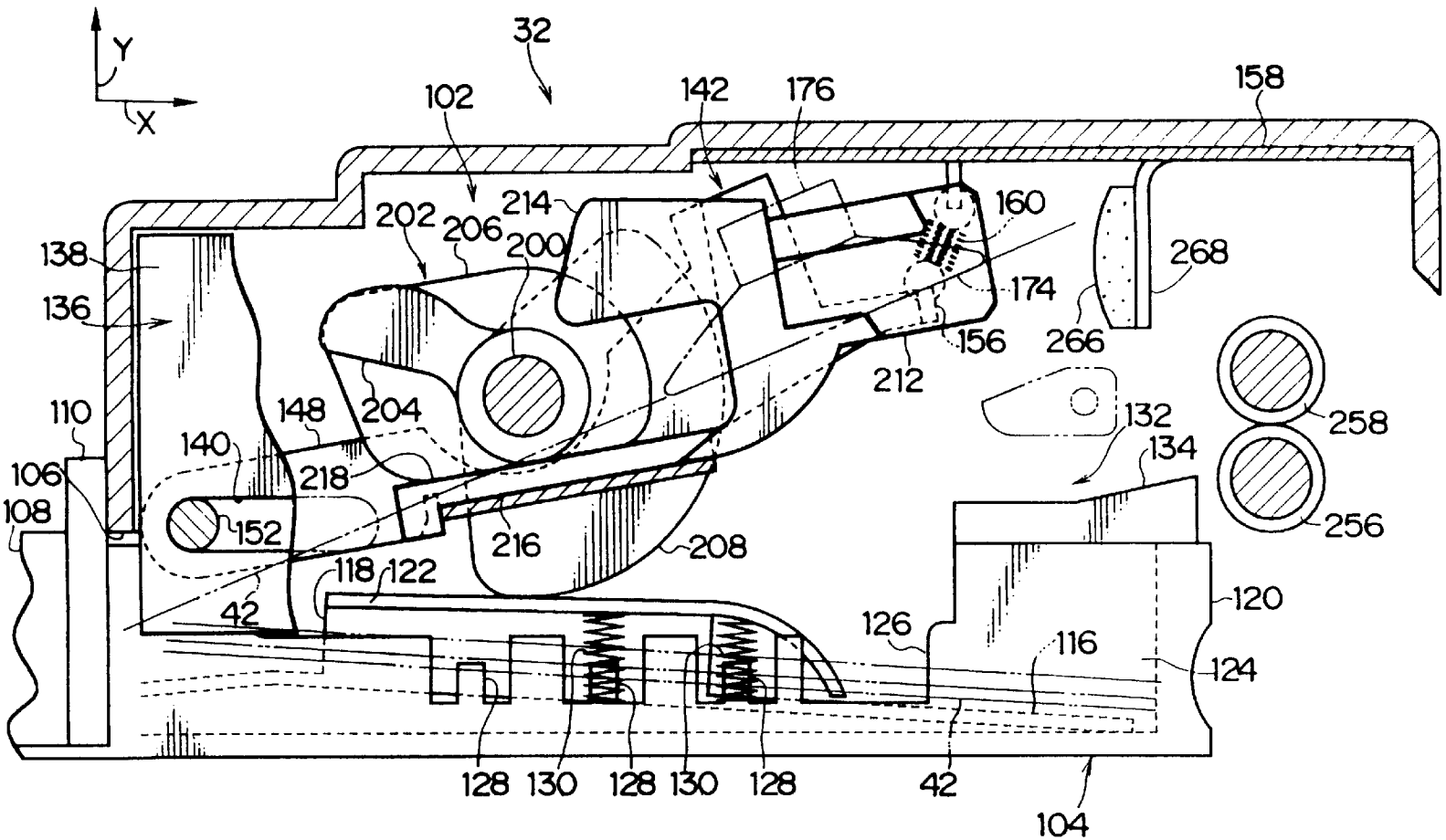
FIG. 13 is a side cross-sectional view corresponding to FIG. 10 for showing a position of the sucker in the state that the sucker has lifted up the material to be adsorbed until the material to be adsorbed is disengaged from the engagement claw.
Figure 18:
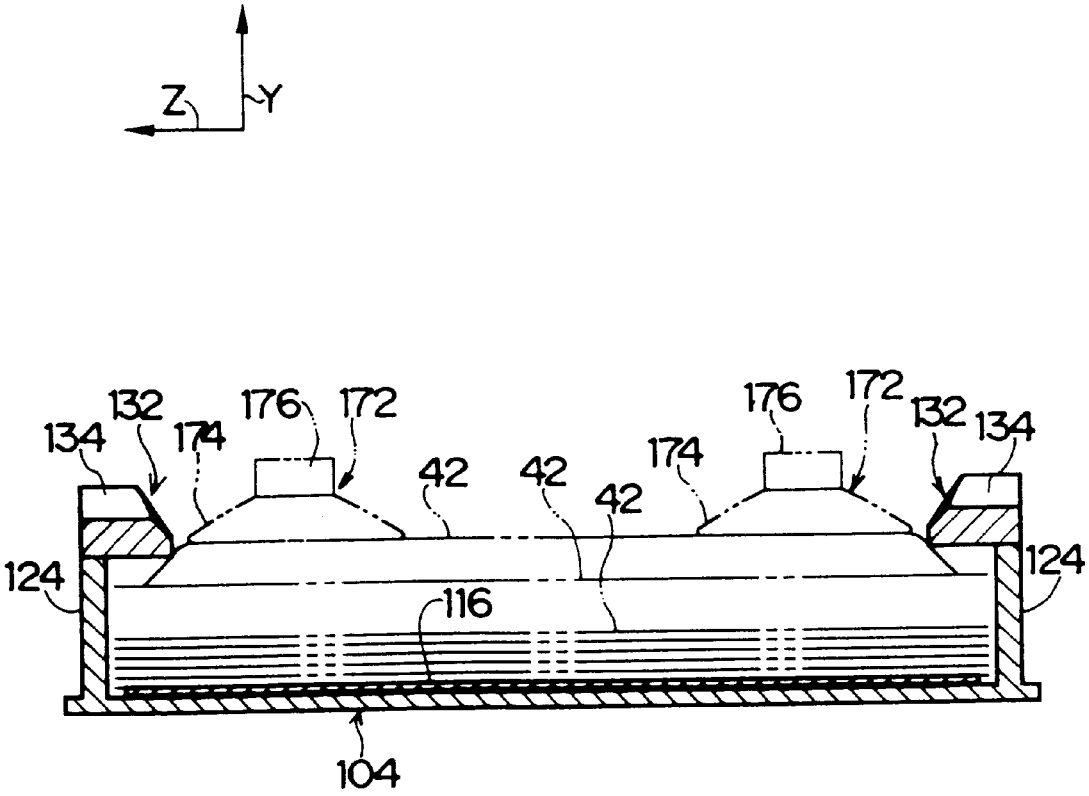
FIG. 18 is a front cross-sectional view for showing the state that the sucker has moved upward from the state of FIG. 17 and the top layer material to be adsorbed has been bent.

Further, during the period while the cam 202 is rotated until the state shown in FIG. 13 has reached, the end portion of the top layer sheet of the image receiving material 42 is brought into contact with the engagement claw 132 and is bent into a U-shape to the downward direction as shown in FIG. 18. In this case, the image receiving material 42 tries to restore its flat state by its own elasticity. Since the second sheet of the image receiving material 42 is simply adhered to the back surface of the top layer sheet of the image receiving material 42 at this time, the second sheet of the image receiving material 42 is separated from the top layer sheet of the image receiving material 42 by the restoring force of the image receiving material 42, and usually drops by the self-weight of the second sheet of the image receiving material 42. Thus, the second sheet is separated from the top layer sheet of the image receiving material 42.

Figure 19:
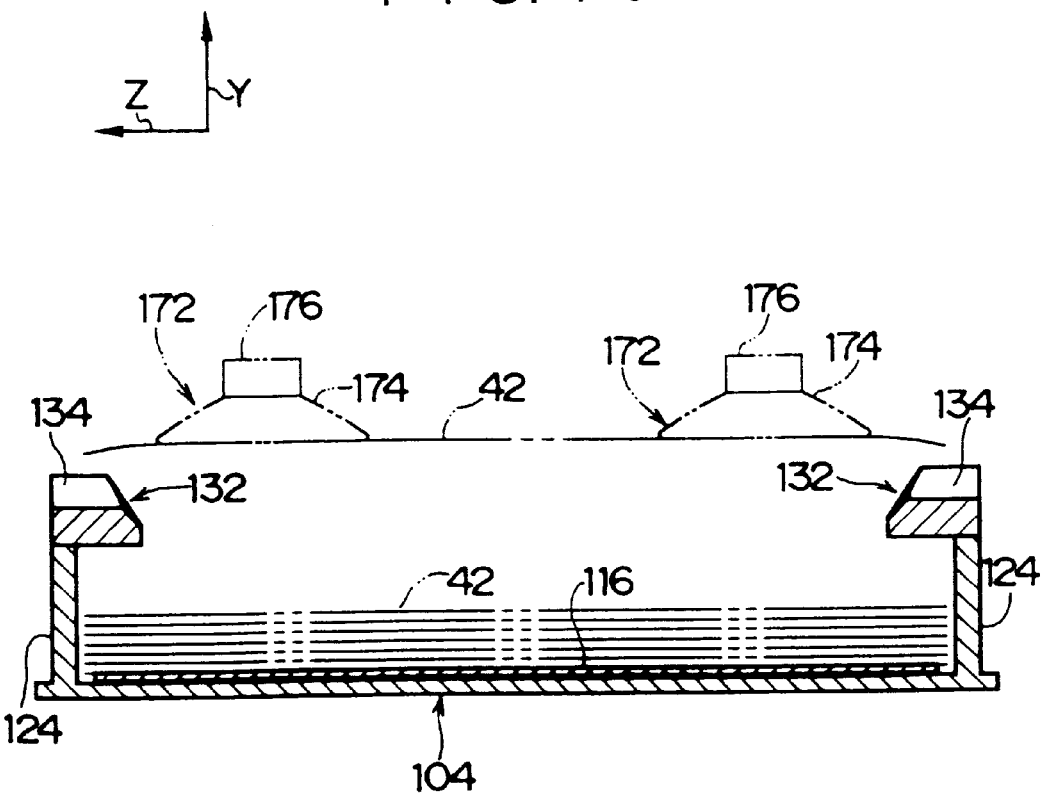
FIG. 19 is a front cross-sectional view of the tray for showing the state of the material to be adsorbed, the push-up unit and the sucker in the state of FIG. 13.

Next, when the cam 202 has rotated to the state shown in FIG. 13, the radius from the rotation center of the second cam section 206 to the contact section of the cam follower 212 becomes further smaller than that in the state shown in FIG. 12, so that the sucker 172 moves further upward as shown in FIG. 19. With this operation, the end portion of the top layer sheet of the image receiving material 42 is disengaged from the engagement claw 132. If the second sheet of the image receiving material 42 is still kept adhered to the rear surface of the top layer sheet of the image receiving material 42 even if the state shown in FIG. 18 has reached, the end portion of the second sheet of the image receiving material 42 is brought into contact with the engagement claw 132 and drops by being separated from the rear surface of the top layer sheet of the image receiving material 42 due to the disengagement of the end portion of the top layer sheet of the image receiving material 42 from the engagement claw 132 (that is, the state shown in FIG. 19). Thus, the second sheet of the image receiving material 42 can be completely separated from the top layer sheet of the image receiving material 42.

Next, when the cam 202 makes a further rotation from this state, the radius of the second cam section 206 becomes the radius of the same length as that of the initial state (that is, the state shown in FIG. 10). With this arrangement, the sucker 172 is lowered to the same position as that in the initial state (that is, the state shown in FIG. 10) against the resilient force of the spring 160. Further, in this case, since the first cam section 204 pushes up the end surface 214 at the back side of the cam follower 212, the swinging arm 148 moves forward along the long hole 140 against the resilient force of the spring 196, so that the sucker 172 comes close to the carrying rollers 256 and 258.

In this case, as shown in FIG. 19, although the image receiving material 42 lifted up by being adsorbed by the sucker 172 bend downward at both end portions in the width direction due to the self-weight of the image receiving material 42, the both end portions are brought into contact with the sloped surface 134 formed on the upper surface of the engagement claw 132 when the position of the sucker 172 is lowered. Further, as shown in FIG. 20, as the sucker 172 comes closer to the carrying rollers 256 and 258, the both end portions in the width direction of the image receiving material 42 are lifted up along the slope of the sloped surface 134 and are then placed in a flat state. Then, the front end portion of the image receiving material 42 is guided into a space between the carrying rollers 256 and 258 as shown in FIG. 16.

Further, when the sucker 172 comes closer to the carrying rollers 256 and 258 at a predetermined distance as shown in FIG. 16, the front end portion of the image receiving material 42 is butt against the space between the carrying rollers 256 and 258, and at the same time, the front end portion of the arm 188 of the sucker pressing member 184 is brought into contact with the pressing member 266, as shown in FIG. 4.

In this case, there is a case that one end side in the width direction of the front end portion of the image receiving material 42 is butt against the space between the carrying rollers 256 and 258 prior to the other end side due to an error in the fitting position of each sucker 172 or a positional deviation of the image receiving material 42 in the state that the image receiving material 42 is accommodated in the tray 104. However, in this case, the posture of the image receiving material 42 can be corrected by the following arrangement. At first, the first cam section 204 presses the cam follower 212 to set the gear reduction ratio of the gears 222 to 234 such that the velocity at which the swinging arm 148 is moved becomes faster than the peripheral velocity of the carrying roller 256. Further, since the sucker 172 itself has an elasticity, the sucker 172 which has adsorbed one end side of the image receiving material 42 is elastically deformed by a repulsive force of the carrying roller 256 or the carrying roller 258 and corrects the posture of the image receiving material 42 during a period while the one end side in the width direction of the front end portion of the image receiving material 42 (that is, the side butt in advance against the space between the carrying rollers 256 and 258) is completely sandwiched between the carrying rollers 256 and 258. With this arrangement, the image receiving material 42 is sandwiched between the carrying rollers 256 and 258 in a correct posture.

Further, when the image receiving material 42 is butt against the space between the carrying rollers 256 and 258, the front end portion of the image receiving material 42 can be accurately sandwiched between the carrying rollers 256 and 258 and thus a sanwiching failure can be securely prevented since both ends in the width direction of the image receiving material 42 are horizontal by the sloped surface 134 of the engagement claw 132.

Further, when the swinging arm 148 is moved forward from this state to a position at which the front end portion of the image receiving material 42 is completely sandwiched between the carrying rollers 256 and 258, the arm 188 is pressed backward by the repulsive force of the pressing member 266, so that the whole of the sucker pressing member 184 moves backward relative to the sucker 172 as shown in FIG. 5. With this arrangement, the lever 194 of the sucker pressing member 184 pushes to widen the supporting hole 178 of the sucker 172, so that a gap is generated between the flange section 168 of the supporting member 166 and the inner periphery of the supporting hole 178. Since a negative pressure is being generated inside the umbrella section 174 of the sucker 172 in this state, an external air flows into the inside of the umbrella section 174 of the sucker 172 through the piercing holes 182 and 184. Thus, the negative pressure inside the umbrella section 17 4 is cancelled and the adsorption of the image receiving material 42 by the sucker 172 is cancelled.

Accordingly, the present sucker adsorbing unit 171 does not need to have a special structure for cancelling the negative pressure of the umbrella section 172. In other words, the sucker adsorbing unit 171 does not require a pump for sending air to the umbrella section 172 or a valve for taking in air, or a control unit for operating or releasing the pump and valve when the sucker 172 has reached a predetermined position. Thus, it is possible to securely cancel the adsorption by the sucker 172 in a simple structure.

Further, when the cam 202 has rotated until this state has reached, a light beam emitted from the light emitting device 250 of the photo-interrupter 246 passes through the recess 252 of the cam plate 248 and reaches the light receiving device 254 so that the photo-interrupter 246 is set to an ON state. Then, the control circuit having received this signal inversely drives the motor 240 at the same rotation velocity as the rotation velocity during the driving for a forward rotation. When the output axis 242 rotates in the counter-clockwise direction by this, the gear 232 rotates in the counter-clockwise direction through the gears 222 to 230 (that is, the first gear string). However, the rotation of the gear 232 will not be transmitted to the rotary axis 200 by the one-way clutch 238, but the cam 202 is stopped.

On the other hand, when the output axis 242 rotates in the counter-clockwise direction, the gear 234 rotates in the counter-clockwise direction through the gears 222 to 227 (that is, the second gear string). However, the rotation of the gear 234 will not be transmitted to the carrying roller 256 by the one-way clutch 262, but the turning effort of the output axis 242 in the counter-clockwise direction is transmitted to the carrying roller 256 through the third gear string consisting of the gears 222 to 224 and 236, so that the carrying roller 256 is rotated in the clockwise direction.

In this case, since the gear reduction rate of the gears 222 to 234 has been set such that the rotation velocity of the carrying roller 256 when the turning effort of the output axis 242 has been transmitted through the third gear string is faster than the rotation velocity of the carrying roller 256 when the turning effort of the output axis 242 has been transmitted through the second gear string, the rotation velocity of the carrying roller 256 becomes faster when the motor 240 is driven to rotate in the forward direction. Therefore, it becomes possible to feed promptly the image receiving material 42 to the pasting roller 38 (the outer periphery of the endless belt 36) of the pasting unit 30 at the waiting position through the guiding section 44. Further, when the image receiving material 42 has been fed to a predetermined position by the roller 256, the front end portion of the image receiving material 42 is detected by a sensor not shown and the move timing of the pasting unit 30 is taken based on a signal emitted from the sensor.

Further, the pasting unit 30 moves and the fed image receiving material 42 moves together with the endless belt 36 so that the image receiving material 42 is inverted. Then, sheets of the image receiving material 42 are sequentially superposed together with the photo-sensitive material 24 through the sandwiching of each sheet of the image receiving material 42 between the endless belt 36 and the photo-sensitive material 24.

Further, in this case, prior to the superposing of the image receiving material 42 and the photo-sensitive material 24, water is sequentially coated on the photo-sensitive material 24 by the sponge 54 of the water coating section 34 which moves together with the pasting unit 30, and at the same time, surplus water is removed from the photo-sensitive material 24 by the squeezing roller 60.

With the above-described operation, sheets of the image receiving material 42 are pasted sequentially onto the photo-sensitive material 24 positioned on the stage 20 coated with water.

The sheets of the image receiving material 42 and the photo-sensitive material 24 superposed with each other on the state 20 are heated by the stage 20 in the superposed state, so that a thermal development and transfer is carried out. In other words, movable coloring materials of the photo-sensitive material 24 are discharged, and at the same time, the coloring materials are transferred onto the coloring material fixing layer of the image receiving material 42 so that an image is obtained on the image receiving material 42.

After the thermal development and transfer has been carried out, the pasting unit 30 moves to the initial position in an opposite direction to the above-described direction. By the retrieval of the pasting unit 30, the photo-sensitive material 24 is drawn out by a predetermined length, and at the same time, the image receiving material 42 is moved together with the photo-sensitive material 24 from the other end of the stage 20 to the outside of the stage 20. Along with this movement, sheets of the image receiving material 42 are collected in the exhaust tray 70 after being separated from the photo-sensitive material 24.

Thereafter, the pasting unit 30 and the water coating section 34 become in the waiting state to prepare for the next processing.

On the other hand, in the sheet feeding section 32, the rotary axis 200 is rotated when the motor 240 is driven again in the forward direction during the period from when the pasting unit 30 started to move till when the image receiving material 42 is collected in the exhaust tray 70. After the rotary axis 200 has started to rotate, a light beam emitted from the light emitting device 250 of the photo-interrupter 246 passes through the recess 253 of the cam plate 248 and reaches the light receiving device 254, so that the photo-interrupter 246 is set to the ON state. The control circuit which has received this signal stops the motor 240. With this operation, the cam 202 is set to the initial state and the swinging arm 148 returns to the initial position by the resilient force of the springs 160 and 196 (the state shown in FIG. 10) to prepare for the next processing.

As explained above, according to the sheet feeding section 32 of the image recording apparatus 10 relating to the present mode of implementation, the image receiving material 42 is adsorbed by the sucker 172 of the sucker adsorbing unit 171, and the image receiving material 42 is taken out from the tray 104 in this state and is then supplied to the space between the carrying rollers 256 and 258. As a result, there occurs no hurt on the image forming surface of the image receiving material 42.

Further, since the supply operation of the image receiving material 42 is all carried out by the rotary operation of the one cam 202, including the lifting and forward move of the sucker 172 and the pressing down of the push-up panel 116, a complex control unit for controlling this operation is not required, which results in a low cost.

Further, in the case of taking out the image receiving material 42 from the tray 104 by adsorbing the image receiving material 42 by the sucker 172, the push-up panel 116 is pressed down by the cam 202 (the third cam section 208) so that the sandwiching of the image receiving material 42 between the push-up panel 116 and the engagement claw 132 is cancelled. Therefore, the second sheet afterward of the image receiving material 42 are not bent at the time when the top layer sheet of image receiving material 42 is disengaged from the engagement claw 132. As a result, there occurs no hurt on the image forming surface of the second sheet of the image receiving material 42 due to the friction with the top layer sheet of the image receiving material 42. Moreover, since the second sheet of the image receiving material 42 is sandwiched between the push-up panel 116 and the engagement claw 132 without involving a bending of the second sheet of the image receiving material 42, the second sheet of the image receiving material 42, when it becomes a top layer sheet, can be securely adsorbed for carrying by the sucker 172, thus preventing an occurrence of an adsorption failure.

Further, since the driving force of the motor 240 is transmitted to both the cam 202 and the carrying roller 256 by the first to the third gear strings, and further since the rotation and stopping of the cam 202 and the changing of the rotation velocity of the carrying roller 256 are carried out by changing the driving direction of the motor 240 (that is, the rotation direction of the output axis 242), it is possible to securely match the timing of the operation of the cam 202 and the carrying roller 256. Furthermore, a complex control circuit is required for synchronizing two motors when the cam 202 and the carrying roller 256 are rotated by the separate motors. However, since such a control circuit is not required in the present mode of implementation, the cost of the apparatus becomes inexpensive.

According to the present mode of implementation, the supporting hole 178 of the sucker 172 is a part of the through-hole. However, it is also good to provide a through-hole, separate from the supporting hole 178, on the sucker 172, for communicating with the piercing hole 180 and for being connected to an external air by an elastic deformation of the through-hole by applying a pressing force of the lever 194. Furthermore, the direction of the elastic deformation by the pressing force of the lever 194 is not limited to the diameter direction of the umbrella section 174 but may also be in other direction such as a contracted diameter direction or an axial direction.

Further, although a negative pressure is generated by the restoring force at the time of the elastic deformation of the sucker 172 (the umbrella section 172) according to the present mode of implementation, it is also good to have such a structure that negative pressure is generated by a sucking unit such as a suction pump for extracting air from within the umbrella section 172.

Further, in the present mode of implementation, although a negative pressure is cancelled and an adsorption is cancelled by elastically deforming the sucker 172 (the supporting section 176) in the expanding diameter direction by the sucker pressing member 184, it is basically good so long as the adsorption of the image receiving material 42 can be cancelled in the state that the image receiving material 42 is sent to the carrying roller 256 in the adsorbed state. Accordingly, it may also be structured such that the negative pressure is cancelled by elastically deforming the supporting section 176 in a contracted diameter direction or in an axial direction. Alternately, a pump for sending air to the inside of the umbrella section 172 or a valve for taking an external air into the inside may also be provided, as described previously.

Further, in the present mode of implementation, although the first to the third cam sections 204, 206 and 208 are formed in the one cam 202, the first to the third cam sections 204, 206 and 208 may also be structured as separate units. Furthermore, in principle, it is good if it is possible to cancel the sandwiching of the image receiving material 42 between the engagement claw 132 and the push-up panel 116 when the image receiving material 42 is taken out by being picked up. Accordingly, it is not necessary to use the cam 202 (the third cam section 208) in the cancelling unit, for example, but a driving unit (such as a motor, for example) to be exclusively used for pressing down the push-up panel 116 may be provided separately. Similarly, it is not necessary to use the cam 202 (the first cam section 204 and the second cam section 206) for controlling the move of the sucker 172, but, for example, a driving unit (such as a motor, for example) to be exclusively used for moving the sucker 172 upward and downward and forward and backward may be provided separately .

Further, in the present mode of implementation, although it is structured such that the carrying roller 256 is rotated in the clockwise direction when the motor 240 is driven to rotate in the forward direction, it is good if the peripheral velocity of the carrying roller 256 in this state is slower than the forward move velocity of the swinging arm 148 (that is, the forward move velocity of the sucker 172). Accordingly, it may also be structured such that the carrying roller 256 stops when the motor 240 is driven to rotate in the forward direction.

Further, as the photo-sensitive material 24, a so-called thermal development photo-sensitive material can be taken up for obtaining a visible image by thermally developing and transferring a latent image obtained by an exposure onto the image receiving material 42 in the existence of an image forming solvent such as water. This thermal development photo-sensitive material basically includes a photo-sensitive halogenated silver emulsion, a reducing agent, a binder and a coloring matter dative compound (this may also be functioned by the reducing agent) on the surface of a supporting unit. Further, an organic metal hydrochlorinated agent may also be included in this.

The thermal development photo-sensitive material may be either for giving a negative image or for giving a positive image to an exposure. As a system for giving a positive image to an exposure, a system for directly using a positive emulsion as a halogenated silver emulsion (there are two kinds of system; a system using a nuclear-making agent, and a system for covering a light beam) or a coloring matter dative compound for discharging a diffusive coloring matter image in a positive shape may be employed.

As a thermal development photo-sensitive material for giving a positive image, a material as described, for example, in the Japanese Patent Application Laid-Open (JP-A) Nos.6-161070 and 6-289555 may be used. Further, as a thermal development photo-sensitive material for giving a negative image, a material as described, for example, in the Japanese Patent Application Laid-Open (JP-A) Nos. 5-181246 and 6-242546 may be used.

Further, as an image forming solvent, water may be used, for example. This water is not limited to a pure water but also includes general water widely used. The image forming solvent may also be a mixed solvent of a pure water with a low boiling-point solvent such as methanol, DMF, acetone, diisobutyl ketone, etc. Further, this may also be a solvent including an image forming promoting agent, an anti-fogging agent, a development stopping agent, a hydrophilic hot solvent, etc.

As explained above, according to the sucker adsorbing unit of the present invention, it is possible to cancel the negative pressure within the adsorbing umbrella section by merely elastically deforming the supporting section of the sucker. Therefore, the apparatus can be provided in a simple structure for controlling the adsorption, particularly for the cancellation of the negative pressure.

What is claimed is:

1. A sheet material supplying apparatus for supplying a plurality of sheet materials in a laminated state by separating each sheet from a top layer sheet material one by one, comprising:

a tray for accommodating said plurality of sheet materials in said laminated state;

push-up means for raising said sheet materials accommodated in said tray from a bottom side of said tray;

an engagement claw for engaging a corner portion of said each sheet material raised by said push-up means and disposing said corner portion of said sheet material between said push-up means and said engagement claw; and sucking means for sucking said sheet material positioned on said top layer among said plurality of sheet materials accommodated in said tray and simultaneously lifting said top layer sheet material of which said corner portion is engaged with said engagement claw to remove said top layer sheet material from said tray.

2. A sheet material supplying apparatus according to claim 1, wherein said push-up means cancels the raisin movement to said engagement claw in a state that said corner portion of said top layer sheet material is engaged with said engagement claw and said sucking means sucks said top layer sheet material.

3. A sheet material supplying apparatus according to claim 2, wherein said push-up means has a push-up panel for raising said sheet materials, said push-up panel is pressed downward in an opposite direction of said engagement claw when said raising movement is cancelled.

4. A sheet material supplying apparatus according to claim 1, further comprising a sloped surface formed on an upper surface of said engagement claw for lifting both end portions of said sheet materials and for setting said sheet materials in a horizontal state.

5. A sheet material supplying apparatus according to claim 1, further comprising a cam, wherein a lifting movement or a forward movement of said sucking means and a down movement of said push-up means are performed by one rotation of said cam.

6. A sheet material supplying apparatus according to claim 5, wherein said cam is driven by one motor, and a rotation and stopping of said cam and a changing of rotation velocity of a carrying roller for carrying said sheet materials are performed by changing a driving direction of said motor.

7. A sheet material supplying apparatus according to claim 1, further comprising:

said sucking means include a supporting section and a sucker having an umbrella section stretched from said supporting section and expanding forward, said umbrella section being brought into contact with said sheet material and sucking said sheet materials by a negative pressure within said umbrella section; and cancelling means for elastically deforming an elastic deforming section provided in said supporting section and for cancelling a suction by connecting an inside of said umbrella section with an external air through said deforming section.

8. A sheet material supplying apparatus according to claim 7, wherein a through-hole for connecting to said inside of said umbrella section is provided in said supporting section and said through-hole communicates with an external air by elastically deforming said supporting section by said cancelling means.

9. A sheet material supplying apparatus according to claim 8, wherein a sucker supporting arm for supporting said supporting section is inserted into said through-hole.

10. A sheet material supplying apparatus according to claim 9, wherein said cancelling means communicates with said through-hole with an external air by elastically deforming said supporting section in an expanded diameter direction.

11. A sheet material supplying apparatus according to claim 8, wherein said cancelling means communicates with said through-hole with an external air by elastically deforming said supporting section in an expanded diameter direction.

12. A sucker unit, comprising:

a supporting section;

a sucker having an umbrella section stretched from said supporting section and expanding forward, said umbrella section being brought into contact with sheet material to be sucked and sucking said material to be sucked by a negative pressure within said umbrella section; and cancelling means for elastically deforming an elastic deforming section provided in said supporting section and for cancelling an adsorption by connecting an inside of said umbrella section with an external air through said deforming section.

13. A sucker unit according to claim 12, wherein a through-hole for connecting to said inside of said umbrella section is provided in said supporting section, said through-hole communicates with an external air by elastically deforming said supporting section by said cancelling means.

14. A sucker unit according to claim 13, wherein a sucker supporting arm for supporting said supporting section is inserted into said through-hole.

15. A sucker unit according to claim 14, wherein said cancelling means communicates with said through-hole with an external air by elastically deforming said supporting section in an expanded diameter direction.

16. A sucker unit according to claim 13, wherein said cancelling means communicates with said through-hole with an external air by elastically deforming said supporting section in an expanded diameter direction.

* * * * *